US010548810B2

(12) United States Patent
Stanbridge

(10) Patent No.: US 10,548,810 B2
(45) Date of Patent: Feb. 4, 2020

(54) SYSTEMS AND METHODS FOR HIGH SPEED VIBRATION THERAPY

(71) Applicant: Rapid Release Technology, LLC, Santa Ana, CA (US)

(72) Inventor: Stanley Robert Stanbridge, Costa Mesa, CA (US)

(73) Assignee: Rapid Release Technology, LLC, Santa Ana, CA (US)

( * ) Notice: Subject to any disclaimer, the term of this patent is extended or adjusted under 35 U.S.C. 154(b) by 1013 days.

(21) Appl. No.: 15/009,177

(22) Filed: Jan. 28, 2016

(65) Prior Publication Data

US 2016/0213558 A1 Jul. 28, 2016

Related U.S. Application Data

(60) Provisional application No. 62/276,386, filed on Jan. 8, 2016, provisional application No. 62/108,712, filed on Jan. 28, 2015.

(51) Int. Cl.

| | |
|---|---|
| ***A61H 23/00*** | (2006.01) |
| ***A61H 23/02*** | (2006.01) |
| ***A61H 7/00*** | (2006.01) |

(52) U.S. Cl.

CPC ..... *A61H 23/0263* (2013.01); *A61H 7/001* (2013.01); *A61H 7/003* (2013.01); *A61H 7/005* (2013.01); *A61H 23/006* (2013.01); *A61H 2201/0153* (2013.01); *A61H 2201/0157* (2013.01); *A61H 2201/0271* (2013.01);

(Continued)

(58) Field of Classification Search

CPC .... A61H 23/0263; A61H 7/001; A61H 7/005; A61H 2201/169; A61H 2201/0271; A61H 23/00; A61H 23/0254; A61H 23/02; A61H 23/006; A61H 2023/002; A61H 23/004;

(Continued)

(56) References Cited

U.S. PATENT DOCUMENTS

| | | | |
|---|---|---|---|
| 1,955,623 | A | 4/1934 | Donoway |
| 2,122,556 | A | 7/1938 | Buffalow |

(Continued)

OTHER PUBLICATIONS

Author: Lennart D. Johns, Title: Nonthermal Effects of Therapeutic Ultrasound: The Frequency Resonance Hypothesis, Date: 2002, Publisher: Journal of Athletic Training vol. 2002;37(3):293-299 Pertinent pp. 293, 293.

(Continued)

*Primary Examiner* — Tu A Vo
(74) *Attorney, Agent, or Firm* — Novel IP

(57) ABSTRACT

A massager providing massaging frequencies in the range of 75 to 250 hertz, and preferably 100 to 200 Hertz is provided. The massager includes a motor for generating rotational motion, an applicator head having multiple treatment surfaces, and a shaft attached to the motor and applicator head for translating the rotational motion to the applicator head. The massager also includes a restraining mechanism attached to the applicator head. The restraining mechanism is configured to prevent the applicator head from rotating, thereby generating a circular motion in each of the treatment surface. The circular motion has diameters in a range of 0.1 mm to 5 mm and a preferred frequency of 100-200 completed circular movements per second.

17 Claims, 18 Drawing Sheets

(52) U.S. Cl.
CPC ..... *A61H 2201/1215* (2013.01); *A61H 2201/169* (2013.01); *A61H 2201/5005* (2013.01)

(58) Field of Classification Search
CPC ..... A61H 23/0218; A61H 2023/0272; A61H 2023/0281; A61H 2023/029; A61H 21/00
See application file for complete search history.

(56) References Cited

U.S. PATENT DOCUMENTS 3,043,293 A * 7/1962 Rider ..... A61H 7/004 601/86
3,322,117 A * 5/1967 McCaw ..... A61H 23/0254 601/49
3,364,922 A * 1/1968 Teranishi ..... A61H 23/0263 601/72
3,545,434 A * 12/1970 Woodruff ..... A61H 7/003 601/137
3,672,355 A * 6/1972 Ogawa ..... A61H 23/0263 601/135
3,710,785 A * 1/1973 Hilger ..... A61H 23/0263 601/15
3,841,321 A 10/1974 Albach
4,102,334 A * 7/1978 Muchisky ..... A61H 23/0254 601/108
4,513,737 A 4/1985 Mabuchi
4,604,993 A 8/1986 Moriwaki
4,742,875 A 5/1988 Bell
4,846,158 A * 7/1989 Teranishi ..... A61H 23/0263 601/72
5,413,550 A 5/1995 Castel
5,803,916 A 9/1998 Kuznets
6,440,091 B1 8/2002 Hirosawa
6,478,755 B2 11/2002 Young
6,500,141 B1 12/2002 Irion
6,568,000 B1 5/2003 Kaufman
6,866,776 B2 3/2005 Leason
7,435,232 B2 10/2008 Liebschner
8,388,560 B2 3/2013 Jian
D729,940 S * 5/2015 Zeng ..... D24/215
9,107,799 B2 * 8/2015 Muchisky ..... A61H 23/0263
D745,180 S 12/2015 Stanbridge
9,237,981 B1 * 1/2016 Clementes ..... A61H 7/003
9,265,689 B2 2/2016 Stanbridge
2001/0027280 A1 10/2001 Huang
2002/0115947 A1 * 8/2002 Young ..... A61H 23/0254 601/70
2002/0161315 A1 10/2002 Harris
2003/0009116 A1 * 1/2003 Luettgen ..... A61H 19/34 601/46
2003/0158505 A1 8/2003 Calvert
2004/0068213 A1 * 4/2004 Fujisawa ..... A61H 23/0263 601/70
2005/0222525 A1 * 10/2005 Muchisky ..... A61H 23/0254 601/112
2006/0047315 A1 3/2006 Colloca
2006/0276731 A1 * 12/2006 Thiebaut ..... A61H 7/003 601/112
2009/0099485 A1 4/2009 Sarvazyan
2009/0306561 A1 12/2009 Naganuma
2010/0217165 A1 * 8/2010 Muchisky ..... A61H 7/005 601/93
2010/0222719 A1 * 9/2010 Cowie ..... A61H 7/005 601/46
2013/0218058 A1 * 8/2013 Ceoldo ..... A61H 7/001 601/46
2014/0202493 A1 * 7/2014 Zelickson ..... A46B 13/02 15/22.1
2014/0288364 A1 9/2014 St Bernard
2014/0309662 A1 * 10/2014 Brewer ..... A45D 34/042 606/131
2015/0148718 A1 * 5/2015 Eigler ..... A61H 15/0085 601/46
2015/0313993 A1 * 11/2015 Bock ..... A61M 37/0092 604/22
2016/0184171 A1 * 6/2016 Poole ..... A61H 7/00 601/46

OTHER PUBLICATIONS

Author: N/A, Title: Nogier Frequencies, Date: Archived by Wayback Machine on Jan. 30, 2008, Publisher: www.nirtherapy.com, Edition: N/A, Pertinent pp. 1, Web Address: http://nirtherapy.com/nogier.php.
International Search Report for PCT/US16/15367, dated Apr. 29, 2016.

* cited by examiner

SYSTEMS AND METHODS FOR HIGH SPEED VIBRATION THERAPY

CROSS-REFERENCE

The present application relies on U.S. Patent Provisional Application No. 62/108,712, of the same title, and filed on Jan. 28, 2015, for priority. In addition, the present application relies on U.S. Patent Provisional Application No. 62/276,386, of the same title, and filed on Jan. 8, 2016, for priority. Both applications are herein incorporated by reference in their entirety.

FIELD

The present specification relates generally to devices and methods for massage therapy. More particularly, the present specification relates to a massage head and a method of delivering a high frequency massaging vibration, for therapy and pain relief, to a portion of the body without generating excess heat.

BACKGROUND

Scar tissue forms in the body as a temporary patching mechanism for wounds caused by surgery, trauma or repetitive stress. Scar tissue fastened to tissues that are not otherwise connected are called adhesions. Adhesions can spread, entrapping nerves, causing pain or numbness and limiting range of motion. Un-diagnosed pain and restricted mobility are likely to be caused by these scar tissue adhesions. Several soft tissue problems may be caused by adhesions. Some of such problems include: carpal tunnel syndrome, tendinosis, muscle spasms, trapped nerves, restricted range of motion, contractures, neuromas, back, shoulder and ankle pain, headaches, knee problems, and tennis elbow.

Known therapies for relieving pain caused by scar tissue adhesions include directing vibrations towards the affected areas. Massaging an affected body part with vibrations such as sound vibrations caused by various types of instruments have been known to provide some pain relief. However, sound vibrations are not as effective as mechanical vibrations for treating pain caused by scar tissue adhesions. This is because while reflection of sound waves occurs at the air-skin interface, mechanical vibrations efficiently transfer compression waves through the skin barrier.

Conventional massagers direct mechanical vibrations of a plurality of frequencies to an affected body part for providing pain relief, but they fail to operate at frequencies needed to vibrate scar tissue adhesion with a resonating frequency.

There is a need for a device that can deliver effective pain relief by operating at a massaging frequency that causes scar tissue adhesions to vibrate with a resonating frequency. There is a need for a device that can operate at specific mechanical vibration frequencies that resonate with different types of body tissues. There is also a need for a device that can operate at particular frequencies known to resonate directly with fibrotic yellow scar tissue without harmful effects to the surrounding tissues. In sum, there is a need for a therapy that uses mechanical vibrations of specific frequencies to reach and treat scar tissue adhesions that are the cause of pain.

SUMMARY

The following embodiments and aspects thereof are described and illustrated in conjunction with systems, tools and methods, which are meant to be exemplary and illustrative, not limiting in scope. The present specification discloses numerous embodiments.

In some embodiments, the present specification discloses a massager comprising: a motor for generating rotational motion; an applicator head comprising a plurality of treatment surfaces; a shaft attached to said motor and said applicator head for translating said rotational motion to the applicator head; a restraining mechanism attached to said applicator head, wherein the restraining mechanism is configured to prevent the applicator head from rotating, thereby generating vibrational motion in said applicator head and a substantially orbital motion in said plurality of treatment surfaces.

Optionally, at least one of the plurality of treatment surfaces projects radially outwards from the applicator head. Optionally, the plurality of treatment surfaces includes a first treatment surface, a second treatment surface, and a third treatment surface and wherein the first treatment surface has a coefficient of friction that is different than the second treatment surface or third treatment surface. Still optionally, the plurality of treatment surfaces includes a first treatment surface, a second treatment surface, and a third treatment surface and wherein the first treatment surface comprises a material that is more compliant than a material covering the second treatment surface or a material covering the third treatment surface. Still optionally, at least one of the plurality of treatment surfaces comprises silicone. Optionally, three of the plurality of treatment surfaces project radially outwards from the applicator head and are positioned equidistant from each other on a periphery of the applicator head.

In some embodiments, a frequency of the vibrational motion may range from 75 Hz to 250 Hz.

In some embodiments, the orbital motion may cause said plurality of treatment surface to move in an approximately circular motion with diameters ranging from 0.1 mm to 5 mm.

In some embodiments, the plurality of treatment surfaces move in an approximately circular motion with a speed ranging from 100 to 200 circles per second.

Optionally, the restraining mechanism comprises a plurality of substantially elongate pins having distal ends attached to the applicator head and proximal ends connected to sockets positioned on a portion of the massager. Optionally, the proximal end of each pin is placed in a socket having a pre-defined volume and wherein the proximal end of each pin floats freely within the socket. Optionally, the proximal end of each pin is barrel-shaped and wherein the socket is substantially cylindrical.

Optionally, the shaft is coupled with a counterweight for balancing centrifugal force caused by eccentric motion of the applicator head.

Optionally, the massager further comprises a bearing mount assembly comprising at least one ball bearing mounted on at least one shaft for operating the applicator head, the shaft being coupled with the shaft attached to said motor and applicator head.

Optionally, the massager further comprises a bearing mount assembly comprising multiple ball bearings mounted on at least one shaft for operating the applicator head, the shaft being coupled with the shaft attached to said motor and applicator head.

In some embodiments, the massager further comprises a circuit board comprising at least a potentiometer and a switch for controlling a speed of the motor.

In some embodiments, the present specification discloses a massager comprising: a motor for generating rotational motion; an applicator head comprising a plurality of treatment surfaces; a rotating shaft attached to said motor and an eccentric shaft attached to said applicator head for translating said rotational motion to the applicator head to a substantially circular motion; a restraining mechanism attached to said applicator head, wherein the restraining mechanism is configured to prevent the applicator head from rotating, thereby generating a substantially circular motion in said plurality of treatment surfaces and wherein the substantially circular motion of said plurality of treatment surfaces has a diameter in a range of 0.1 mm to 5 mm and a frequency of 100-200 circular movements per second.

Optionally, the plurality of treatment surfaces includes a first treatment surface, a second treatment surface, and a third treatment surface, wherein the first treatment surface, second treatment surface, and third treatment surface project radially outward from the applicator head, wherein the first treatment surface is harder than the second treatment surface, and wherein the third treatment surface is rounder than the first treatment surface or second treatment surface.

Optionally, a bearing mount assembly is positioned concentrically relative to at least one of the rotating shaft or eccentric shaft and proximal to the applicator head.

Optionally, said restriction mechanism comprises a cylindrical component positioned around said bearing mount assembly and proximal to said applicator head and wherein the cylindrical component comprises a plurality of protrusions adapted to have a non-friction fit within complementary recesses located in a base of the applicator head.

Optionally, an outer circumference of the cylindrical component comprises at least one channel, wherein said at least one channel is adapted to accommodate a member connecting the applicator head to a proximal portion of the massager.

The aforementioned and other embodiments of the present specification shall be described in greater depth in the drawings and detailed description provided below.

BRIEF DESCRIPTION OF THE DRAWINGS

These and other features and advantages of the present specification will be further appreciated, as they become better understood by reference to the detailed description when considered in connection with the accompanying drawings.

DETAILED DESCRIPTION

The present specification discloses a high speed vibration therapy, referred to as rapid release technology (RRT) employed in scar tissue therapy, which targets brittle scar tissues with the shearing force of planar wave energy that is readily absorbed by the brittle scar tissues but passes safely through healthy tissue. The present specification also provides an RRT massager having multiple massaging heads capable of vibrating at an optimal frequency that resonates with the scar tissue for maximum effectiveness.

Mechanical vibrations in the frequency range of 100-200 Hz directly administered to tendons or muscles cause a reflex response, termed as 'tonic vibration reflex' (TVR) response. This reflex response quickly relaxes the tendons or muscles causing pain relief. The RRT therapy of the present specification uses frequencies between 100-200 Hz causing a TVR response to be generated by an affected body tissue. The elicitation of the TVR in the neuromuscular system maximizes the benefits of the vibration therapy. The RRT vibration therapy enhances the excitement of corticospinal pathways to assist in the activation of cortical motor areas.

The massager of the present specification may be used to effectively provide pain relief from scar tissue adhesion conditions such as carpal tunnel syndrome, tendinosis, muscle spasms, trapped nerves, range of motion, contractures, neuromas, back, shoulder and ankle pain, headaches, knee problems, and tennis elbow. The vibration therapy of the present specification may also be used to provide relief in other tissue related pain causing conditions as well.

The present specification is directed toward multiple embodiments. The following disclosure is provided in order to enable a person having ordinary skill in the art to practice the invention. Language used in this specification should not be interpreted as a general disavowal of any one specific embodiment or used to limit the claims beyond the meaning of the terms used therein. The general principles defined herein may be applied to other embodiments and applications without departing from the spirit and scope of the invention. Also, the terminology and phraseology used is for the purpose of describing exemplary embodiments and should not be considered limiting. Thus, the present invention is to be accorded the widest scope encompassing numerous alternatives, modifications and equivalents consistent with the principles and features disclosed. For purpose of clarity, details relating to technical material that is known in the technical fields related to the invention have not been described in detail so as not to unnecessarily obscure the present invention.

Figure 1A:
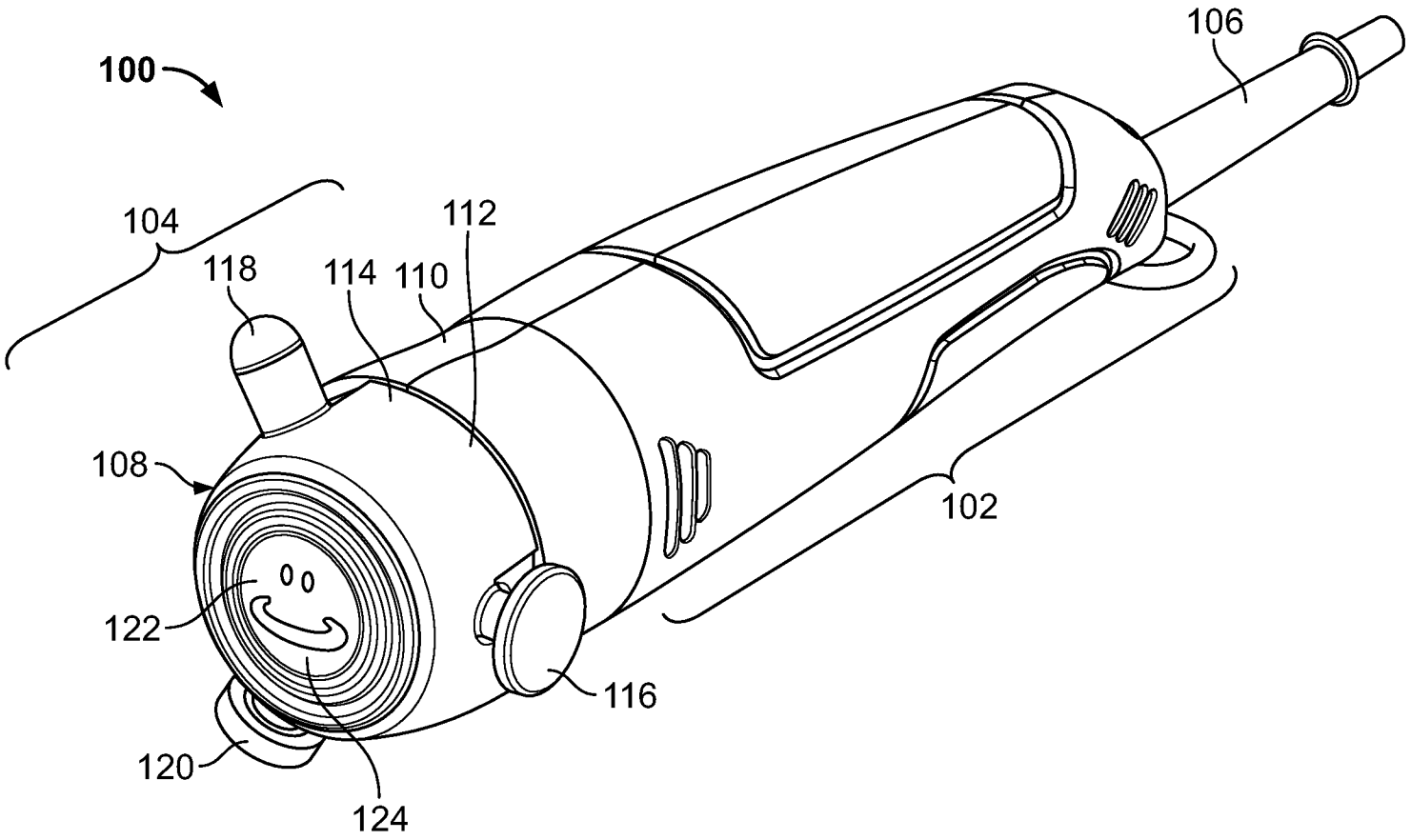
FIG. 1A illustrates a massager, in accordance with an embodiment of the present specification.

FIG. 1A illustrates a massager that employs rapid release technology, in accordance with an embodiment of the present specification. Massager 100 comprises a body portion 102, an applicator head or massager head portion 104 and a power cable 106. The applicator or massager head 104 comprises a vibrating head assembly 108 and a cover 110. The vibrating head assembly 108 and the cover 110 attach at circumferential point 112. In an embodiment, the cover 110 comprises two parts: a first cover and a second cover. The vibrating head assembly 108 comprises a vibrating head 114, a planar, flat or slightly curved treatment surface 116, a rounded treatment surface 118, a soft, flat treatment surface 120, and a front cover 122 that includes a large, contoured treatment surface 124. In some embodiments, body portion 102 further comprises a contoured handle portion that is used to hold the massager during use, affording the user a steady grip. In one embodiment, the planar treatment surface 116 is larger than the rounded treatment surface 118 or the soft planar treatment surface 120. In one embodiment, the soft planar treatment surface 120 has a lower durometer value than either the planar treatment surface 116 or rounded treatment surface 118. In one embodiment, the planar treatment surface 116 has a higher durometer rating than either the soft planar treatment surface 120 or rounded treatment surface 118. In one embodiment, the planar treatment surface 116 has a larger surface area than either the soft planar treatment surface or rounded treatment surface 118. In one embodiment, the rounded treatment surface 118 is substantially cylindrical and has a smaller surface area than either the soft planar treatment surface 120 or planar treatment surface 116.

Figure 1B:
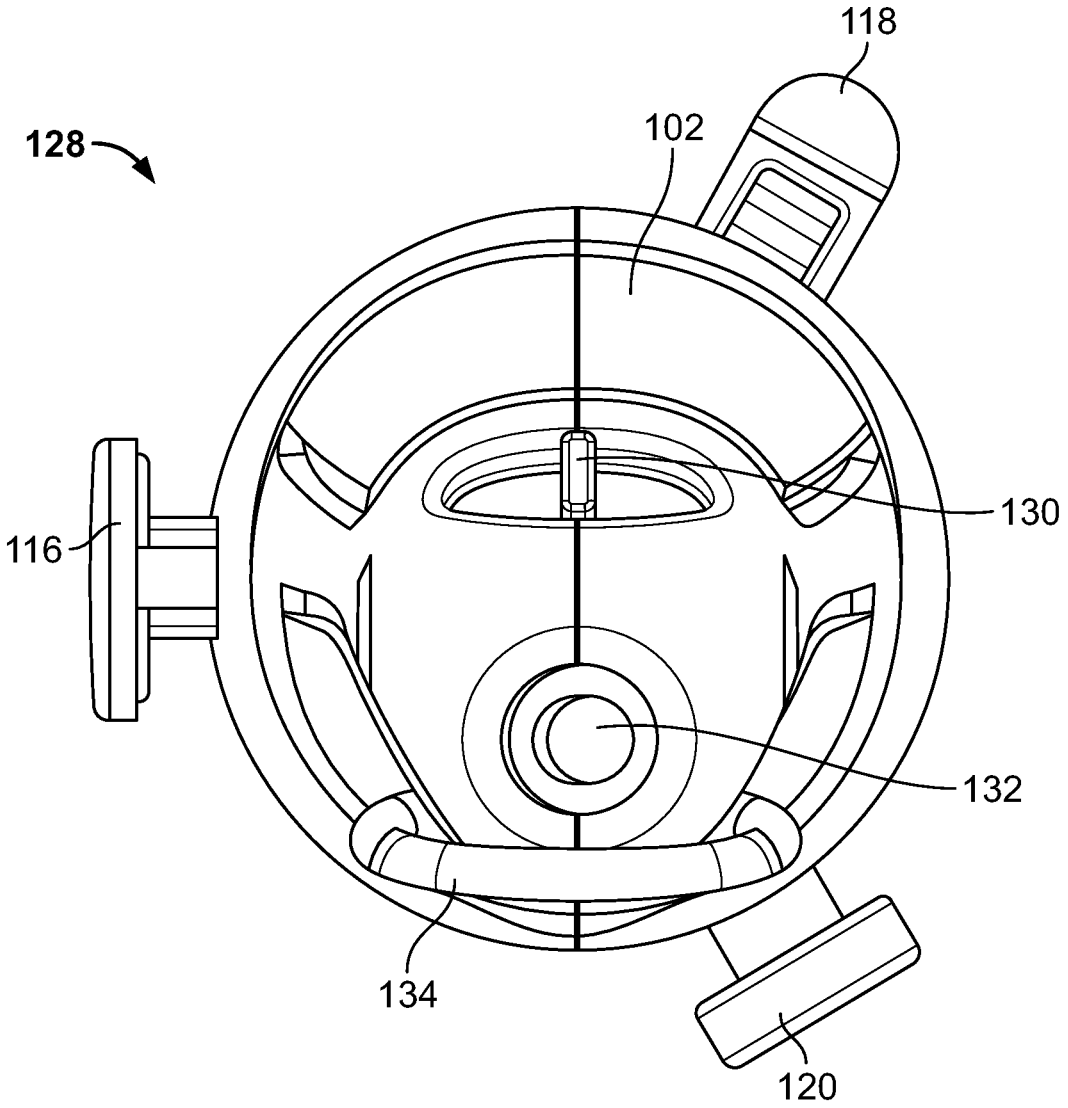
FIG. 1B is a schematic back plan view of the massager, in accordance with an embodiment of the present specification.

FIG. 1B illustrates a back view of the massager, in accordance with an embodiment of the present specification. A back portion 128 of the body 102 of the massager comprises a switch shuttle 130, a connection point 132 for connecting the massager with a power cable, and a curved hang ring 134. In various embodiments, the switch shuttle 130 is used to switch on the massager, enabling the treatment heads 116, 118, 120 to vibrate.

Figure 1C:
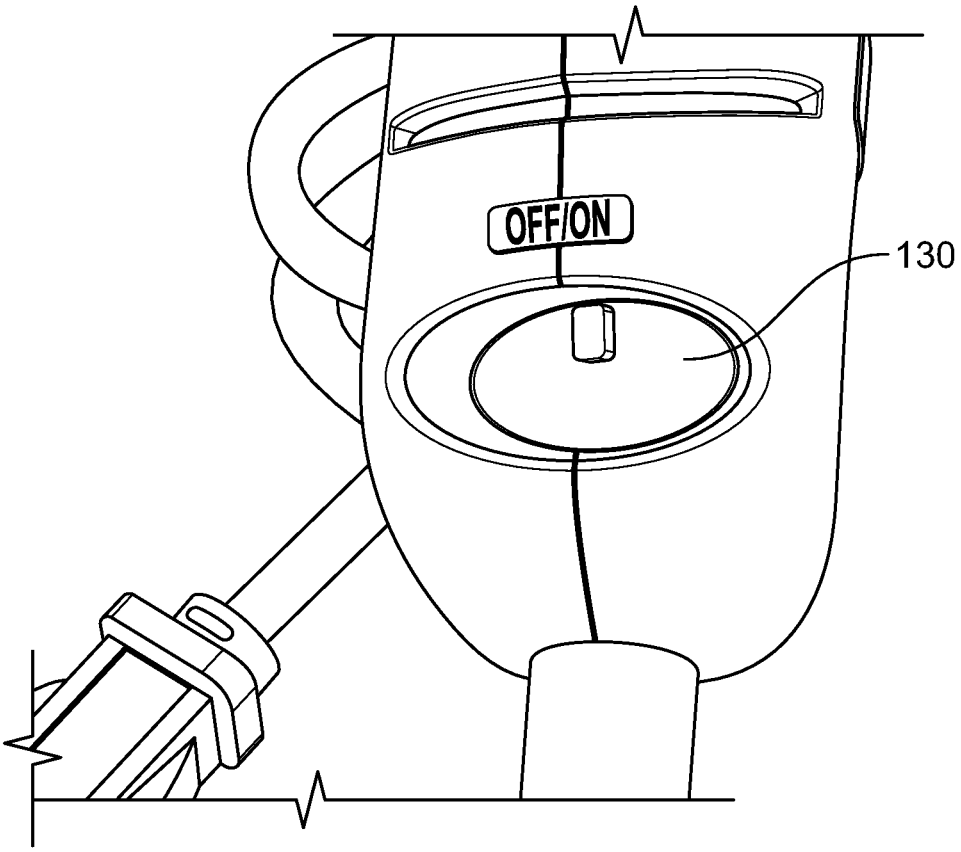
FIG. 1C illustrates a switch shuttle of the massager, in accordance with an embodiment of the present specification.

FIG. 1C illustrates the switch shuttle 130, in accordance with an embodiment of the present specification. Switch shuttle 130 is coupled with a switch provided on a circuit board of the massager (shown in FIG. 3). The switch is coupled with a potentiometer and a motor and is used to control the rotational speed of the motor, which in turn controls the vibrational speed of the one or more treatment heads. A user is enabled to power the treatment heads as well as control their vibrational speeds by operating the switch (shown in FIG. 3) via the switch shuttle 130. In an embodiment, the switch shuttle 130 allows for the user to toggle between a power on and power off state. In another embodiment, the switch shuttle may allow for the user to toggle between different power levels, such as, but not limited to low, medium and high, through which the vibration frequency can be controlled. A low power level equates to a first vibration frequency. A medium power level equates to a second vibration frequency. A high power level equates to a third vibration frequency, where the first vibration frequency is lower than the second vibration frequency which is lower than the third vibration frequency. In other embodiments, the switch shuttle may allow for the user to toggle between incremental power levels, which may be represented by a number, such as 1, 2, 3, . . . n. In an embodiment, the switch shuttle 130 can be used to power only one treatment head at a time or less than all treatment heads at a time.

Figure 2B:
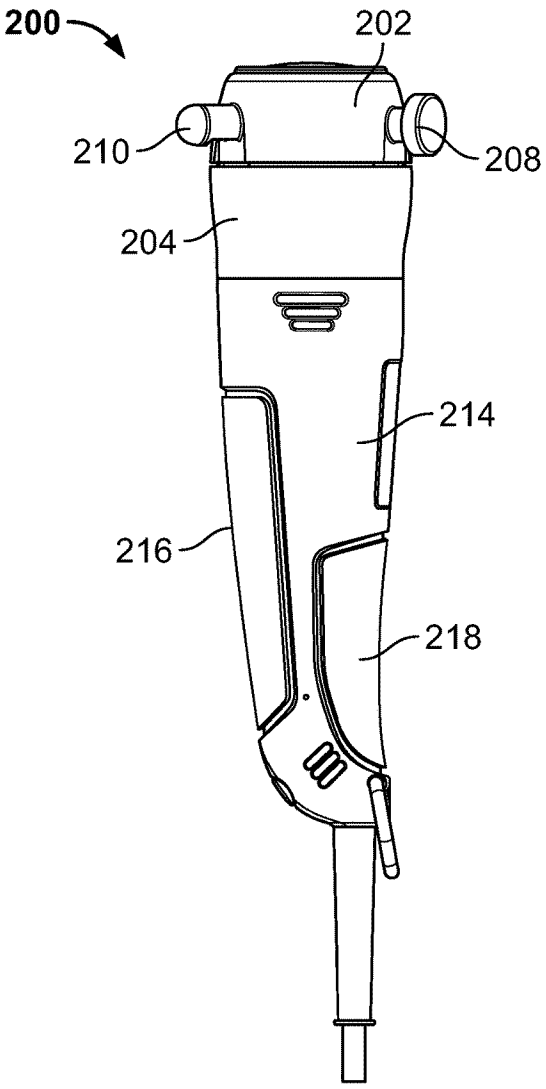
FIG. 2B illustrates a top view of a second side of massager housing, in accordance with an embodiment of the present specification.
Figure 2A:
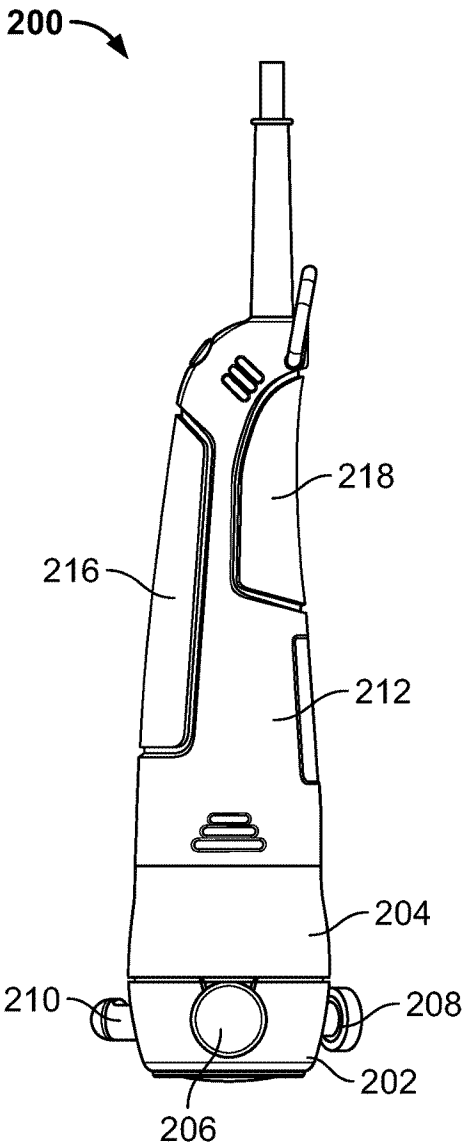
FIG. 2A illustrates a top view of a first side of a massager housing, in accordance with an embodiment of the present specification.
Figure 2D:
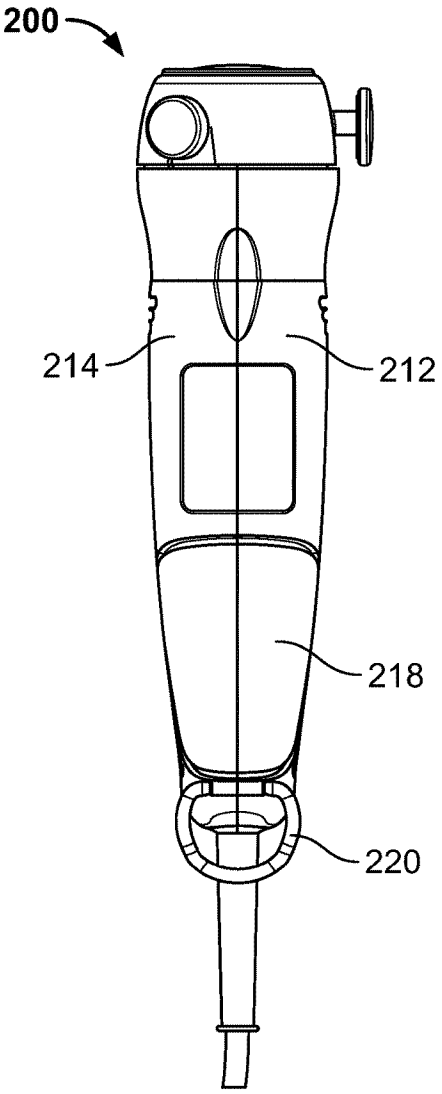
FIG. 2D illustrates another view of the massager housing, in accordance with an embodiment of the present specification.
Figure 2C:
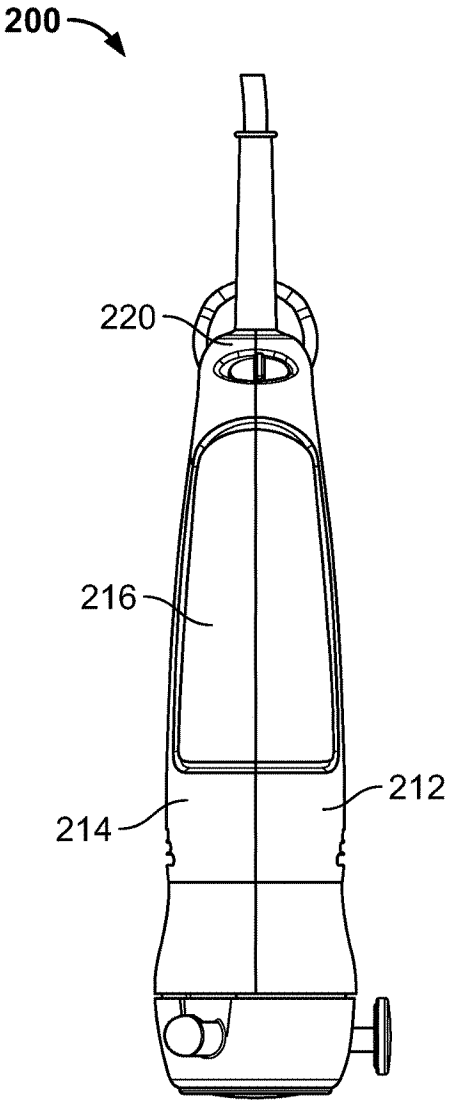
FIG. 2C illustrates another view of the massager housing, in accordance with an embodiment of the present specification.

FIG. 2A illustrates a top view of a first side of the massager housing, in accordance with an embodiment of the present specification. FIG. 2B illustrates a top view of a second side of the massager housing, in accordance with an embodiment of the present specification. FIGS. 2C and 2D illustrate two more external views of the massager, in accordance with an embodiment of the present specification. Referring to FIGS. 2A and 2B, 2C and 2D, massager 200 comprises a vibrating head 202 and a housing 204 for containing a bearing mount assembly. Massager 200 further includes a first motor housing portion 212 and a second motor housing portion 214. Each of the first and second motor housing portions 212, 214 covers at least a portion of the body of the massager. In an embodiment, the first and second covers 212, 214 enclose and protect a motor (shown in FIG. 3) which enables the vibration of treatment surfaces 206, 208 and 210 to vibrate. The vibrating head 202 comprises a large treatment surface 206, a small treatment surface 208, and a soft treatment surface 210. The first and second covers 212, 214 comprise an oblong portion 216 on a top side of the massager and a smaller oblong portion 218 on an underside of the massager. Further, at least a portion of covers 212, 214 functions as a contoured handle portion, in accordance with an embodiment of the present specification, which is used to hold the massager during use and allows a user a steady grip. In some embodiments, the handle portion has a length of 9 inches. In some embodiments, the device of the present specification has an overall length of 10.5 inches. In some embodiments, the handle may also be used for hanging the massager when not in use via a hang ring 220 (shown in FIGS. 2C and 2D).

Figure 2E:
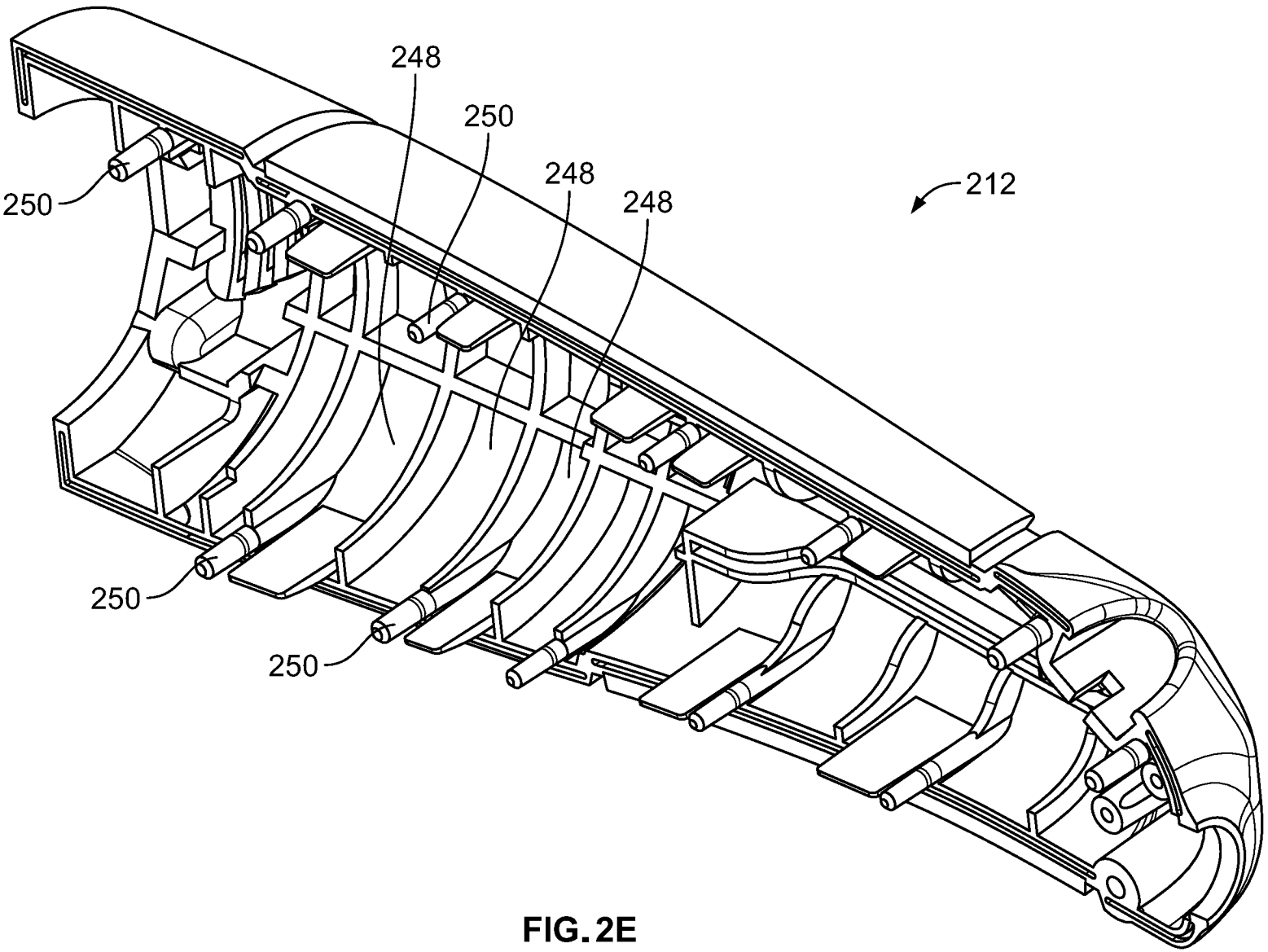
FIG. 2E illustrates an internal view of the massager housing, in accordance with an embodiment of the present specification.
Figure 2F:
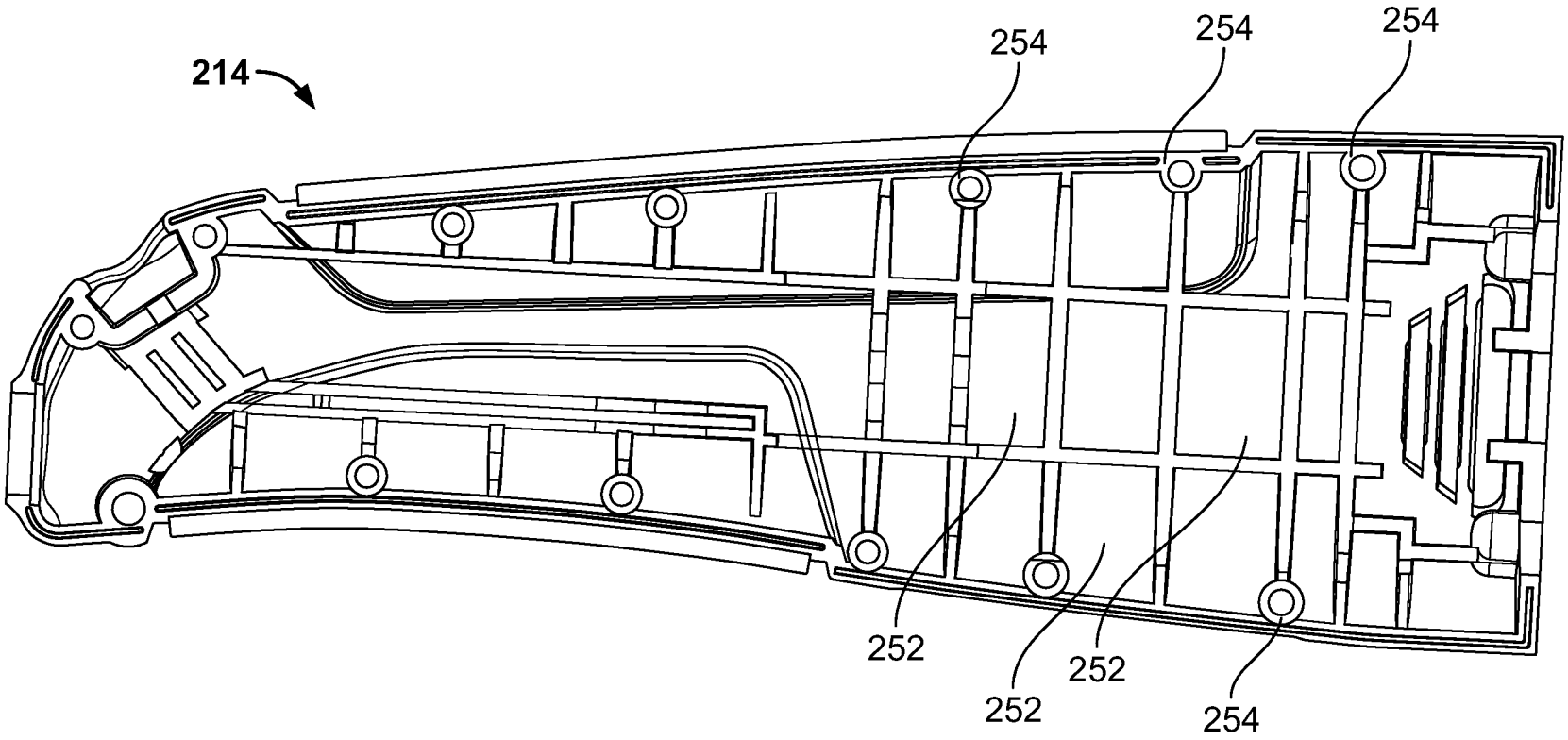
FIG. 2F illustrates an isometric view of the massager housing in accordance with an embodiment of the present specification.

FIG. 2E illustrates an isometric view of the first cover 212 of the massager in accordance with an embodiment of the present specification. The inside of the first cover 212 comprises multiple slots 248 for holding a motor of the massager and multiple pins 250 for connecting with the second cover 214 of the massager. FIG. 2F illustrates an isometric view of the second cover 214 of the massager in accordance with an embodiment of the present specification. The inside of the second cover 214 comprises multiple slots 252 for holding a motor of the massager and multiple pins 254 for connecting with the first cover 212 of the massager.

Figure 3:
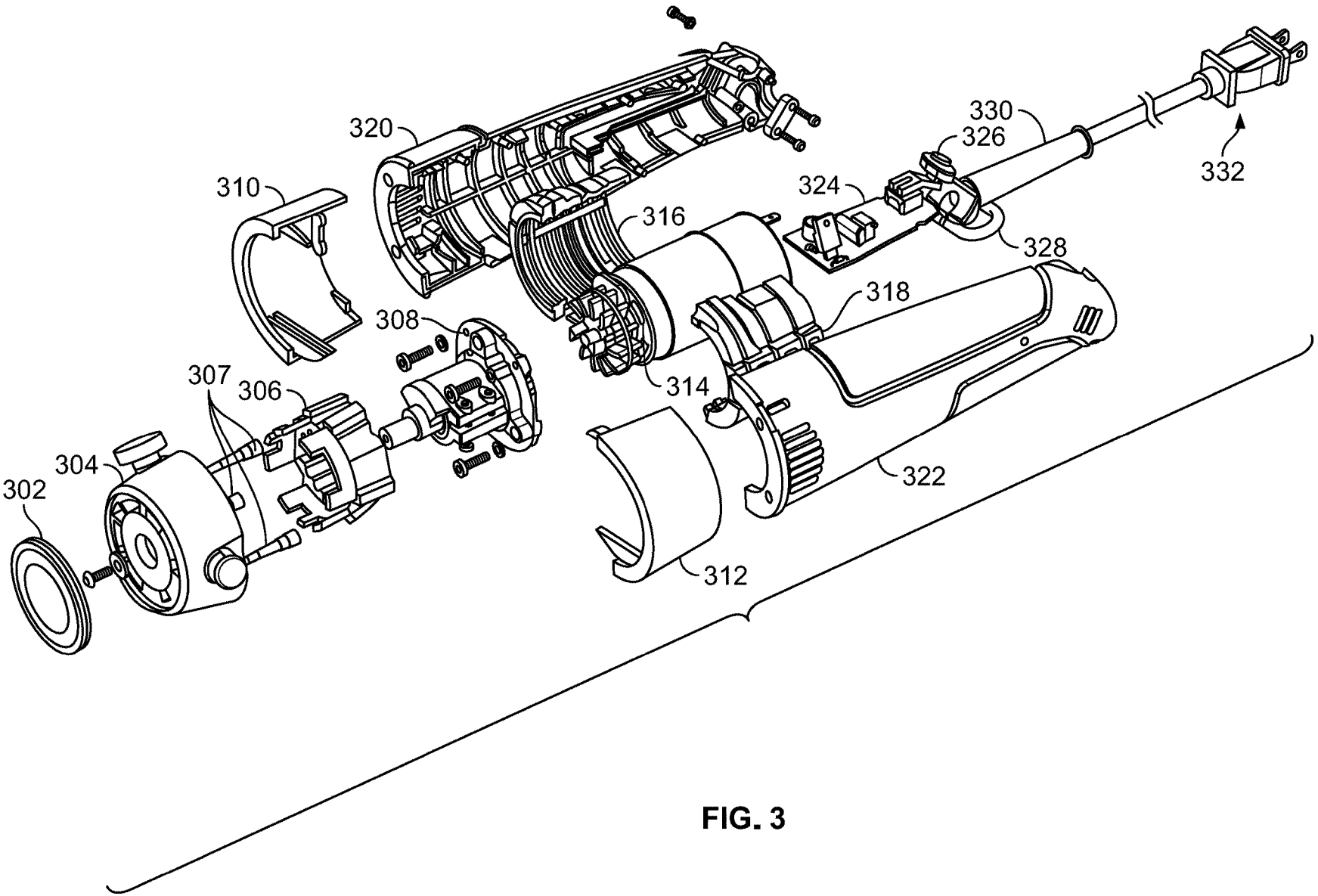
FIG. 3 is an exploded view illustrating internal components of the massager, in accordance with an embodiment of the present specification.

FIG. 3 is an exploded view illustrating internal components of the massager, in accordance with an embodiment of the present specification. Massager 300 includes, but is not limited to, treatment area/disc 302, orbiting head assembly 304, rotation stabilizer or collar 306, pins 307, bearing mount assembly 308, first bearing mount assembly housing portion 310, second bearing mount assembly portion 312, motor assembly 314, first motor mount portion 316, second motor mount portion 318, first motor housing portion 320, second motor housing portion 322, printed circuit board 324, switch actuator 326, hang ring 328, PCB cable 330, and plug 332. Massager 300 may also include additional components such as screws and washers. The treatment area/disc 302 is detachably positioned within, or connected via a pin or member to, the orbiting head assembly 304. Pins 307 connect the orbiting head assembly 304 to the rotation stabilizer or collar 306 which, in turn, is attached to a bearing mount assembly 308 and encased within the first bearing mount assembly housing portion 310 and second bearing mount assembly portion 312. The bearing mount assembly 308 and hence the rotation stabilizer 306 and orbiting head assembly 304 are mechanically connected to the motor assembly 314. Motor assembly 314 is positioned within the first motor mount portion 316 and second motor mount portion 318 and the entire assembly 314, 316, 318 is positioned within the first motor housing portion 320 and second motor housing portion 322. Proximal to the motor assembly and in electrical communication therewith is printed circuit board 324 and switch actuator 326. Hang ring 328, PCB cable 330, and plug 332 are proximal thereto. The functionality and components of the individual components described above are described in greater detail below with respect to the figures that follow.

Figure 4A:
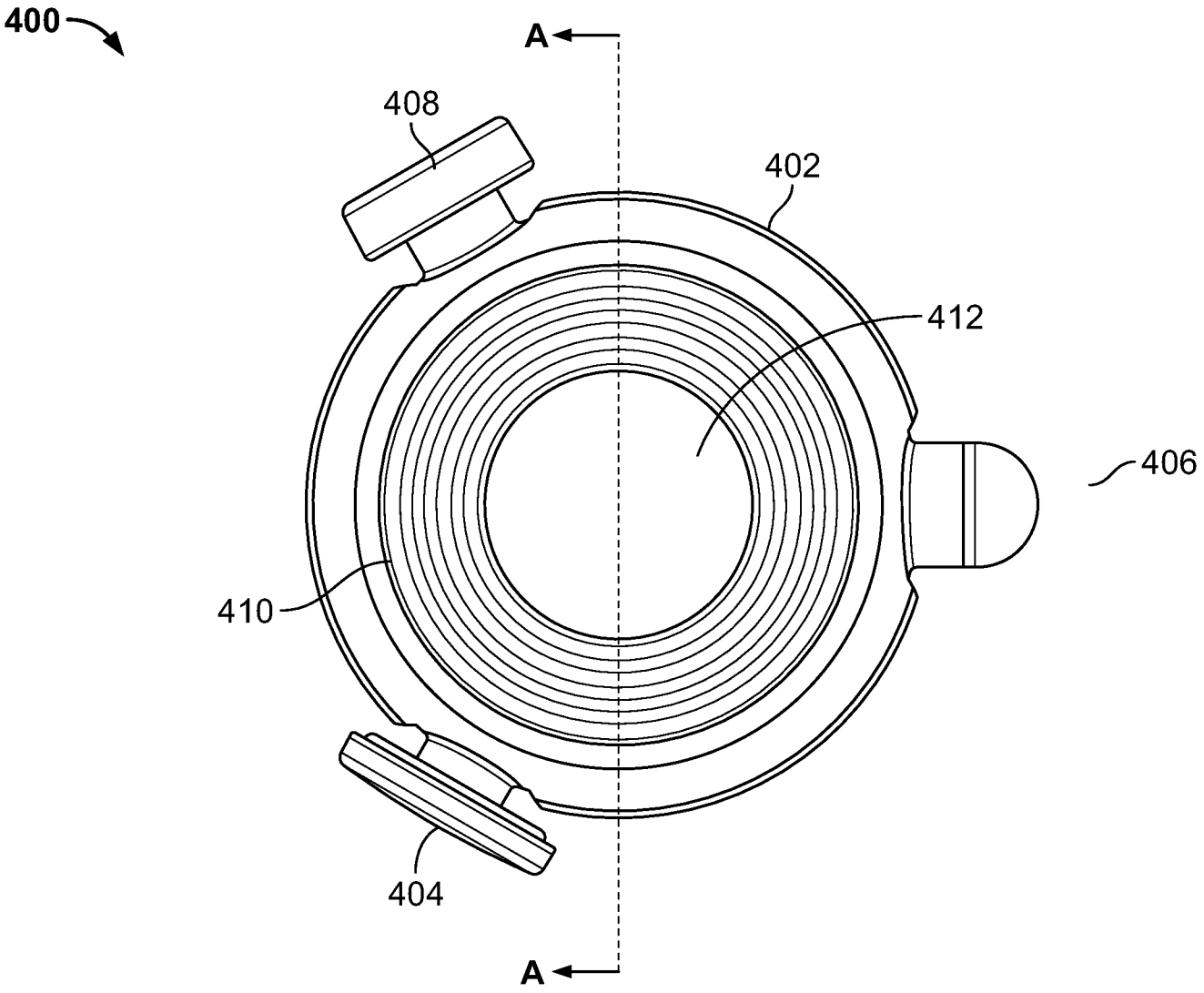
FIG. 4A illustrates an isometric view of a vibrating head assembly of the massager, in accordance with an embodiment of the present specification.

FIG. 4A illustrates a front view of the head of the massager, in accordance with an embodiment of the present specification. The head 400 comprises a vibrating or micro-orbiting portion 402 (referred to as the vibrating head assembly 108 in FIG. 1A), a large planar treatment area 404, a small rounded treatment area 406, a soft planar treatment area 408, and a front cover 410. Front cover 410 comprises a contoured treatment surface 412. Treatment areas or surfaces 404, 406 and 408 are, in an embodiment, positioned equidistantly around the periphery at a proximal end of the head 400. In an embodiment, treatment areas 404, 406, and 408 are positioned at 120 degrees from one another. Each treatment surface or area is constructed differently to provide a different type of massage therapy. The center of treatment area 412 is a smooth circle with at least one circumferential groove positioned therein. In some embodiments, small treatment area 406 comprises a rounded treatment application surface, while the large treatment area 404 and the soft treatment area 408 comprise flat treatment application surfaces. Large treatment area 404 may have a larger treatment application surface than the other treatment areas 406 and 408. In an embodiment, treatment area 404 is flat, hard and smooth. In an embodiment, treatment area 406 is round, hard, and smooth. In an embodiment, treatment area 408 is flat, soft, and smooth. In an embodiment, soft treatment area 408 comprises a silicone surface which is pliant and has a greater traction or frictional coefficient as compared to the large treatment area 404, which comprises a hard and less pliant surface, such as plastic. Further, the treatment areas 404, 406 and 408 extend radially outwards from head 400 and each of the treatment areas 404, 406, 408 has a treatment application surface that is normal to treatment area 412. The difference in design and material of the treatment areas and thus, surfaces 404, 406, 408 and 412 allows a user to apply a plurality of pressure/surfaces on an affected body part, without having to change massage heads, using only one hand, and without having to change the position of that hand. For example, the choice of material allows for the soft treatment area 408 to be used comfortably over bone dense areas.

During operation of the massager the head 402 vibrates with a pre-defined frequency, causing each of the treatment areas (and corresponding surfaces) 404, 406, 408, and 412 to move in an orbital fashion where the diameter of that motion is pre-defined. In an embodiment, the pre-defined frequency ranges from 70 to 250 Hz. In another embodiment, the pre-defined frequency ranges from 100 to 200 Hz. In some embodiments, the speed of the orbital motion of the treatment areas ranges from 100 to 200 circles per second. In another embodiment, each treatment surface 404, 406, 408 and 412 orbits with a high frequency making 130 to 200 circular motions in a second. In another embodiment, each treatment surface 404, 406, 408 and 412 orbits in a range of 150 to 175 circular motions in a second.

In an embodiment, the vibrating head 400 causes each of the treatment surfaces 404, 406, 408 and 412 to move in small orbital, or substantially circular or elliptical, increments having diameters ranging from 0.1 mm to 5 mm. In another embodiment, the diameter ranges from 0.5 mm to 3 mm. In another embodiment, the diameter of the orbit is 1.7 mm. It should be appreciated that the orbital motion may not be a perfect circle but, rather, may be a generally rounded motion that has a varying degree of diameter ranges, from 0.1 mm to 5 mm.

Since the orbital motion of the treatment surfaces are short stroke, elliptical, circular, or otherwise rounded movements, the treatment surfaces do not push away a user's skin upon application, as compared to a up and down motion or in and out motion. As the diameter of the stroke (stroke size) decreases, the frequency (or speed) may be increased in a compensatory manner to achieve the same effect, as can be tolerated by the user. The treatment areas and, thus, surfaces 404, 406, 408, and 412 may be pressed against a body part for massaging said part. Each treatment area and corresponding surface 404, 406, 408, and 412 provides a different type of massage sensation as well as relief to the body part being massaged. The high frequency motion of the treatment surfaces directly administered to tendons or muscles causes a reflex response, termed as 'tonic vibration reflex' (TVR) response. This reflex response quickly relaxes the tendons or muscles causing pain relief.

Also, during operation of the massager, the motion of each treatment area 402, 404, 406 and 412 is substantially identical, allowing a user to easily move from one treatment area to another without having to change modes of operation, replace heads, or even change hand positioning distinctly, for experiencing the different massage sensations provided by the different treatment surfaces.

In various embodiments, the massager of the present specification may be provided with a plurality of treatment surfaces as the same high frequency, short stroke motion of the head 400 is transferred to all the treatment surfaces concurrently. In an embodiment, the radial, arcuate surface on an outside of the vibrating portion 402 between each radial treatment area (404, 406, 408) is also used as a treatment surface and may be covered with a compliant material, or texturized differently. Further, in another embodiment, more than three radial treatment surfaces are provided and positioned around the outer periphery of the vibrating portion 402. In various embodiments, the treatment surfaces provided on the massager may be of different shapes such as but not limited to rectangular, triangular, oblong, pentagonal, hexagonal, and octagonal.

Figure 4B:
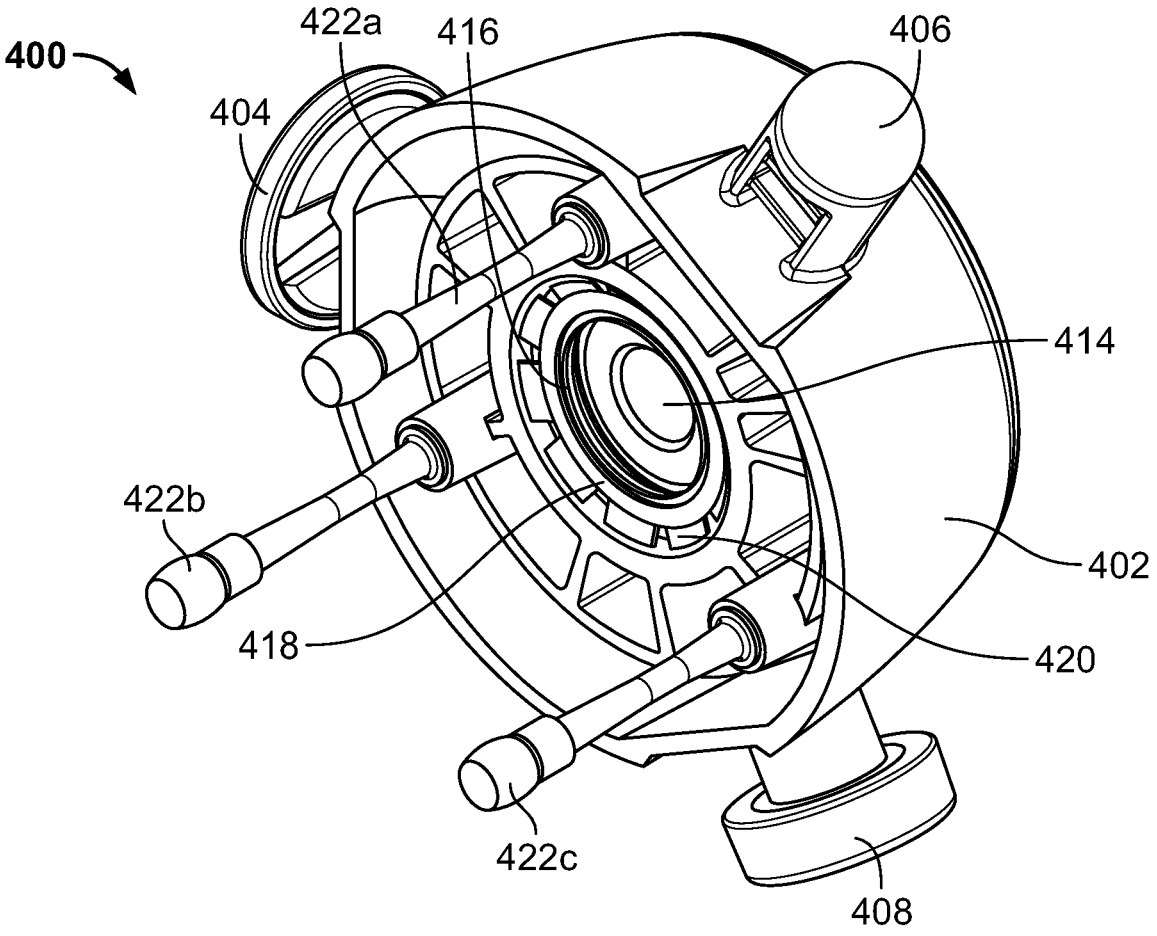
FIG. 4B illustrates an isometric view of a vibrating head assembly of the massager, in accordance with an embodiment of the present specification.
Figure 4C:
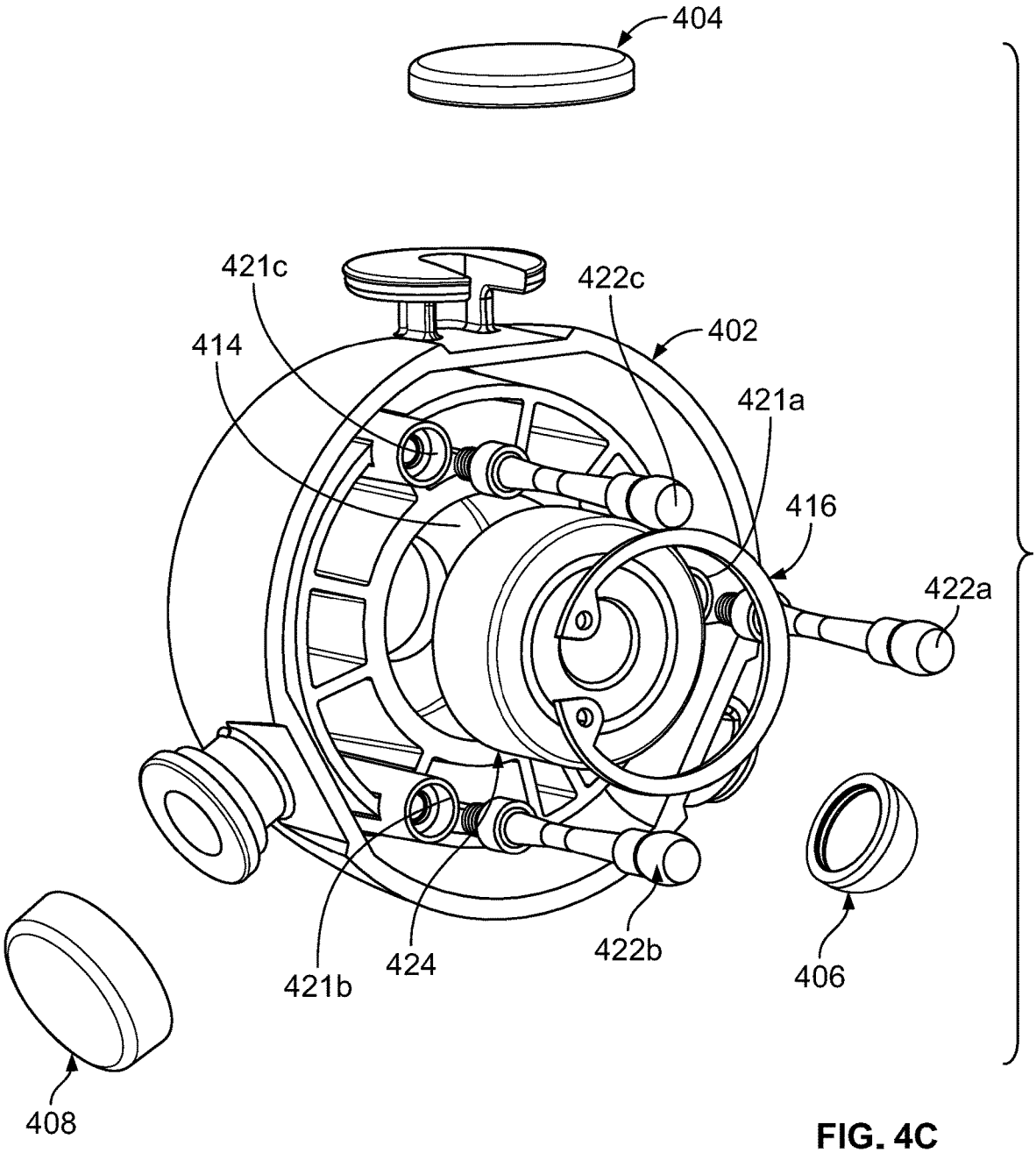
FIG. 4C is an exploded, isometric view of a vibrating head assembly of the massager, as shown in FIG. 4B.

FIG. 4B illustrates an isometric view of the head of the massager, in accordance with an embodiment of the present specification. FIG. 4C is an exploded, isometric view of a vibrating head assembly of the massager, as shown in FIG. 4B. Referring now to FIGS. 4B and 4C, the vibrating portion 402 comprises a ball bearing contact area 414 for receiving at least one ball bearing 424, at least one retaining member 416 positioned within an internal groove, a washer 418 and a retaining clip 420 for retaining the ball bearing within the vibrating portion 402. In embodiments, retaining member 416 may be a wave spring, an internal retaining ring or any other similar mechanism for retaining the at least one bearing in place, as may be known to those of ordinary skill in the art. The vibrating portion 402 also comprises three pins 422*a*, 422*b* and 422*c* for connecting the vibrating portion 402 to the body of the massager. The pins 422*a*, 422*b* and 422*c* also restrict the free rotatory motion of the vibrating portion 402. As illustrated, pins 422*a*, 422*b* and 422*c* are positioned equidistantly around the circumference of head 400 (FIG. 2A). Distal ends of pins 422*a*, 422*b* and 422*c* are attached to an inside of vibrating portion 402.

In various embodiments, the vibrating portion 402 is made to move in an orbiting motion by means of a motor (not shown in FIG. 4B). Further, in various embodiments, during operation of the massager, the orbiting motion of the vibrating portion is restricted by using any suitable restricting means. In the embodiment illustrated in FIG. 4B, the three pins 422*a*, 422*b* and 422*c* extending from the vibrating portion 402 to the body of the massager restrict free rotatory movement of the vibrating portion 402, thereby generating an orbital motion of the head 400. The use of motion restricting means such as pins 422*a*, 422*b* and 422*c* cause the head 400 to vibrate with a high frequency and very short orbital strokes.

In the embodiment shown in FIG. 4C distal ends of pins 422*a*, 422*b* and 422*c* are firmly attached to the head 400 in sockets 421*a*, 421*b* and 421*c* respectively, while the proximal ends are free floating within sockets provided on a bearing mount assembly. Having the proximal ends free floating reduces heat generation, load, and extraneous vibrations, as compared to having the proximal end glued or fixedly attached in place. In an embodiment the distal ends of pins 422*a*, 422*b* and 422*c* are threaded and/or glued or affixed by any other means, to sockets 421*a*, 421*b* and 421*c*, respectively, located inside of the vibrating portion 402. In an embodiment, the proximal ends are positioned within substantially cylindrical sockets located on the bearing mount assembly, which allow the pins 422*a*, 422*b* and 422*c* to move freely, but restricted within, the space inside each socket. In embodiments, the proximal end of each of the pins has a curved, barrel-like shape. The placement of the pins within the sockets on the bearing mount assembly provides a restricting force to the rotatory movement of the vibrating portion 402.

In various embodiments, various other restricting means that connect the head 400 to a body of the massager may be used. In an optional embodiment, the shafts of the pins (the portions between the distal and proximal ends) are positioned through grooves provided on a rotation stabilizer (also referred to as a crown, collar or cylindrical component), described in greater detail with reference to FIGS. 5A through 5E. Further, in an embodiment, a plurality of protrusions of the rotation stabilizer act as means to restrict a rotatory motion of the head while allowing for vibration of the head.

In an embodiment, the rotation stabilizer collar fits around the bearing mount assembly to at least restrict the circular motion of the vibrating head. In addition, the cylindrical component stabilizes the rotational aspect of the massager head such that the rotation is substantially circular and does not wobble or alter rotational movement should the stabilizing pins dislodge from their cylindrical sockets on the bearing mount assembly. Further, the placement of the cylindrical component or crown acts as a failsafe mechanism, ensuring stable substantially circular orbit should at least one the pins bend, break, or otherwise detach from the assembly. Without such a stabilizer should the pins break, the massage head would rotate and subsequently affect the vibrational accuracy of the massage head.

Figure 5A:
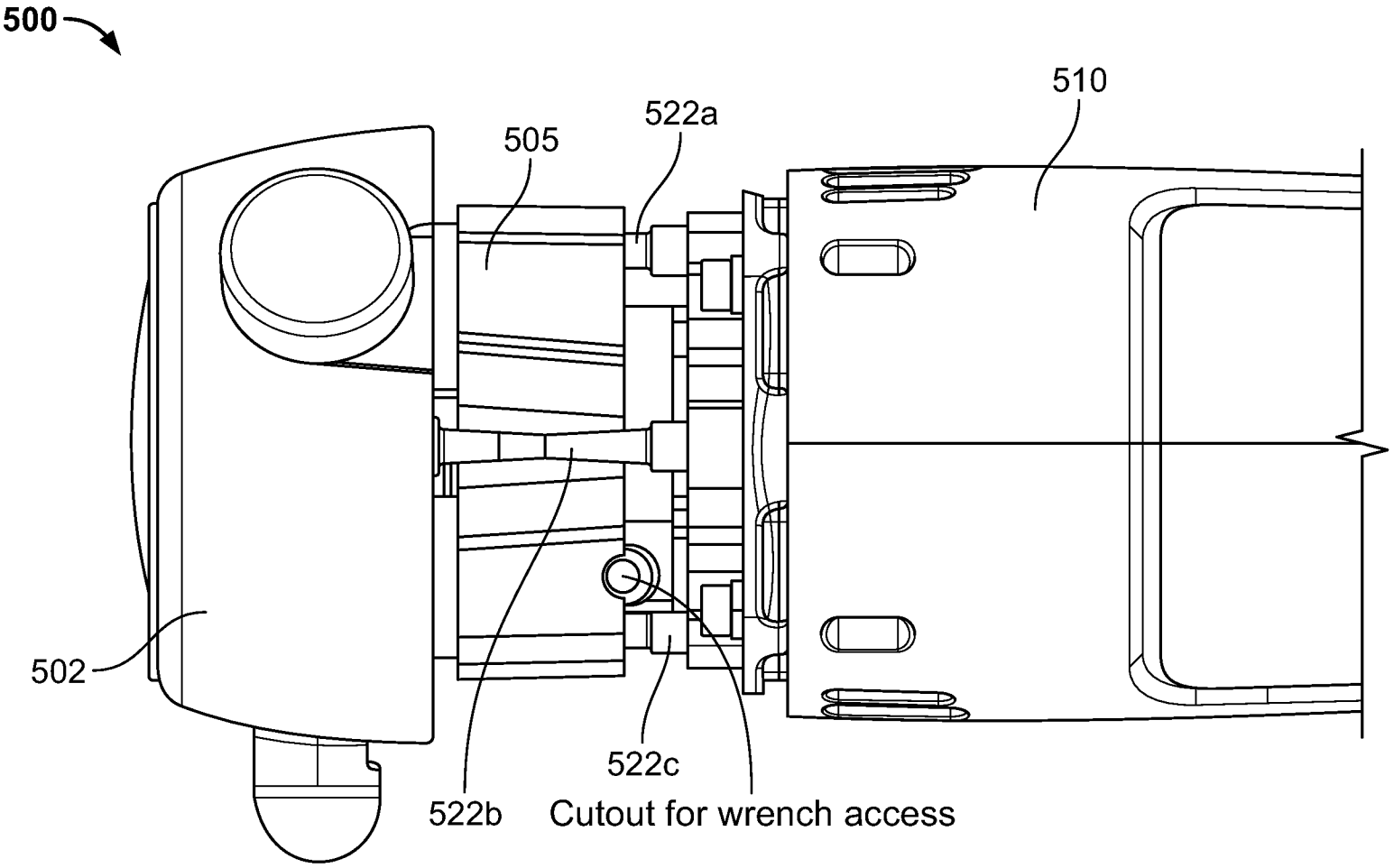
FIG. 5A is a first perspective view of the massager, showing a cylindrical component fitted over a bearing mount, in accordance with an embodiment of the present specification.
Figure 5B:
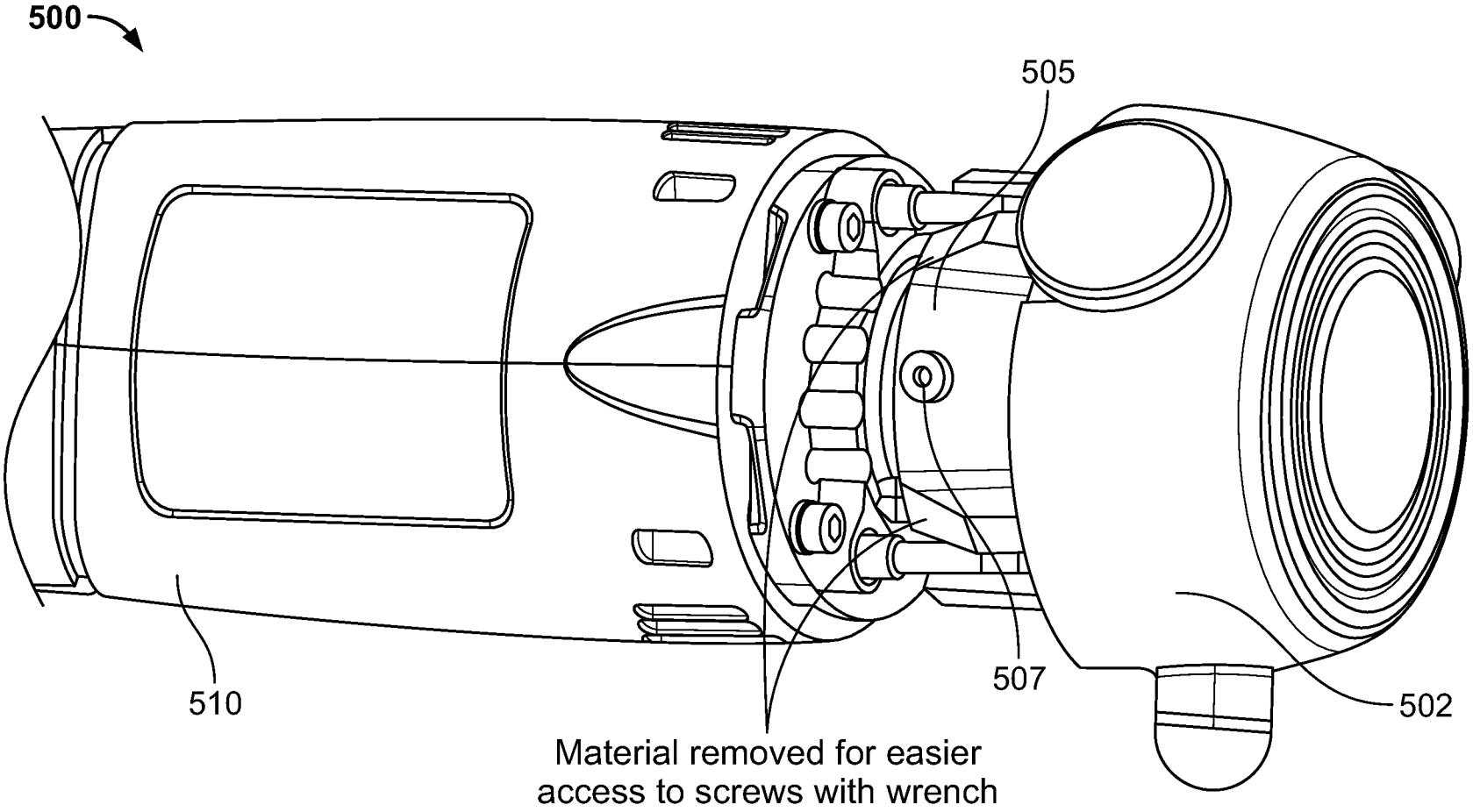
FIG. 5B is a second perspective view of the massager of FIG. 5A.

FIGS. 5A and 5B are first and second perspective views of the massager 500, in accordance with an embodiment of the present specification. The figures show a cylindrical component 505, also referred to as a crown, collar or cylindrical component, fitted over a bearing mount assembly placed between a vibrating head 502 and a body 510 of the massager 500 (as shown in FIG. 3). In accordance with an aspect of the present specification, the cylindrical component 505 serves a plurality of benefits, such as to block a gap between the vibrating head 502 and the body 510 of the massager 500 so that a recipient, patient or end user's skin, jewelry, or hair do not get caught or entangled and to act as one of the means of stabilizing, restricting or blocking rotation of the head 502 while allowing the head 502 to vibrate. In one embodiment, the cylindrical component 505 is securely attached to the underlying bearing mount assembly using one or more screws 507 (FIG. 5B).

Figure 5C:
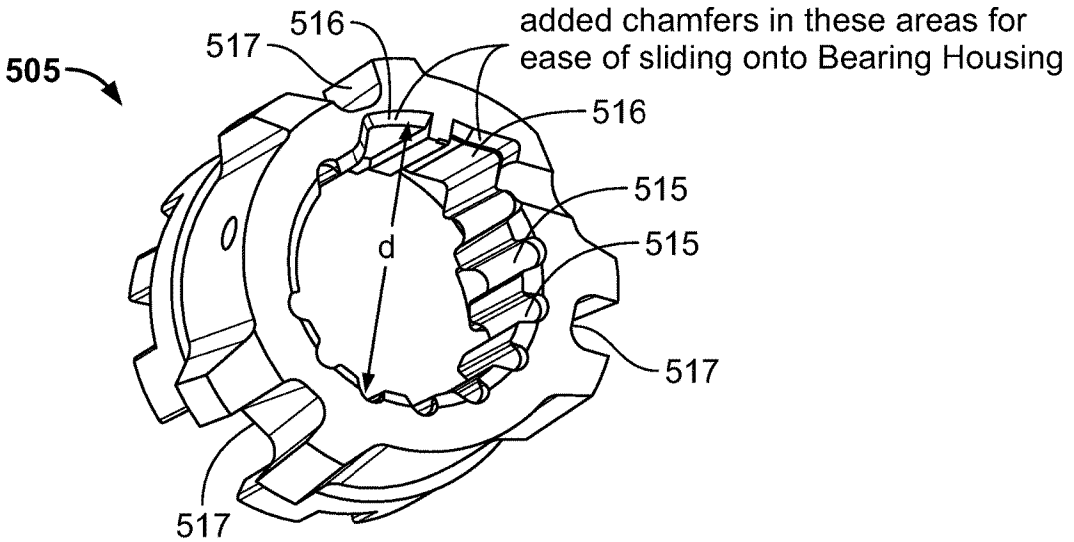
FIG. 5C is a first perspective view of a cylindrical component of the massager in accordance with an embodiment of the present specification.
Figure 5E:
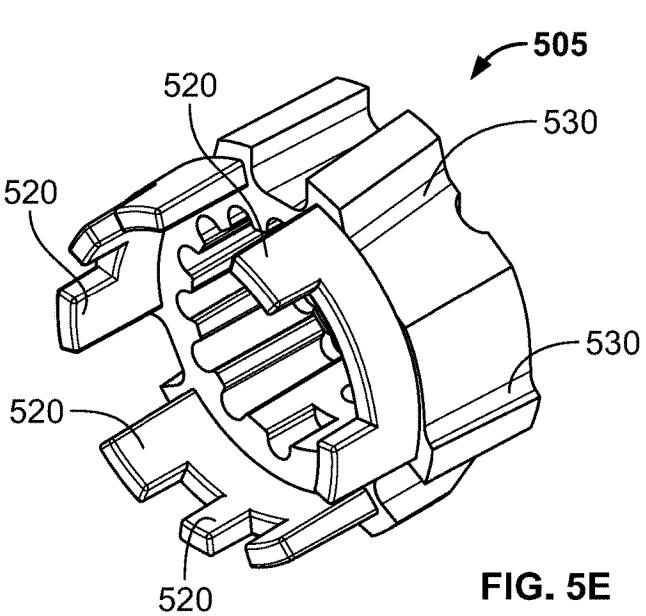
FIG. 5E is a third perspective view of the cylindrical component of FIG. 5C.
Figure 5D:
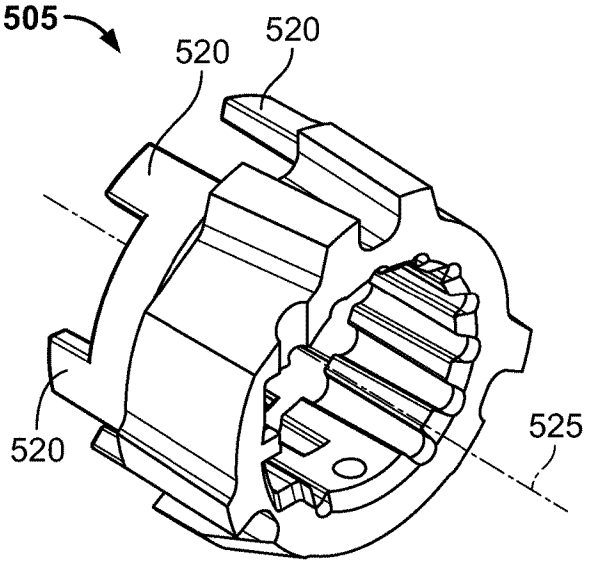
FIG. 5D is a second perspective view of the cylindrical component of FIG. 5C.

FIGS. 5C, 5D and 5E are first, second and third perspective views of the cylindrical component 505 in accordance with various embodiments. In an embodiment, cylindrical component has a diameter ranging from approximately 1.0 inches to 2.5 inches. In an embodiment, the thickness of cylindrical component 505 ranges from 0.3 inches to 0.7 inches. Referring now to FIGS. 5A through 5E, an internal circumference of the cylindrical component 505, is adapted (in terms of the internal diameter 'd', for example) to fit around the bearing mount assembly. The internal circumference has a plurality of channels 515, or grooves, to allow for air flow and heat to pass through when the component 505 is fitted around the bearing mount assembly. In an embodiment, 11 grooves 515 are provided and are equidistantly spaced. In addition, a space is provided for grooves 516, which are used to receive the bearing mount assembly. An outer circumference of the cylindrical component 505, includes three channels 517, or grooves, to accommodate the shaft portions of the three pins 522*a*, 522*b*, 522*c* (also shown as pins 422*a*, 422*b* and 422*c* of FIG. 4B) that connect the head 502 to the body 510. Grooves 517 are positioned approximately 120 degrees from one another.

A plurality of protrusions 520, together forming a crown portion, extends from one side of the component 505 along a central longitudinal axis 525. The plurality of protrusions 520 are adapted or configured to conform and fit into a plurality of recesses (shown as recesses 625 of FIG. 6) formed into a base of the head 502. In accordance with an embodiment, the protrusions 520 have a non-friction fit into the recesses of the base of the head 502 to prevent the head 502 from rotating while allowing for the head 502 to vibrate. While the pins are spaced equidistantly from each other, the protrusions 520 are "keyed" or spaced to fit within the recesses such that there is only one accurate method of placing the components together. In some optional embodiments, the pins 522*a*, 522*b* and 522*c* may be eliminated, since the crown protrusions 520 act as means to restrict rotatory motion of the head 502.

Figure 6:
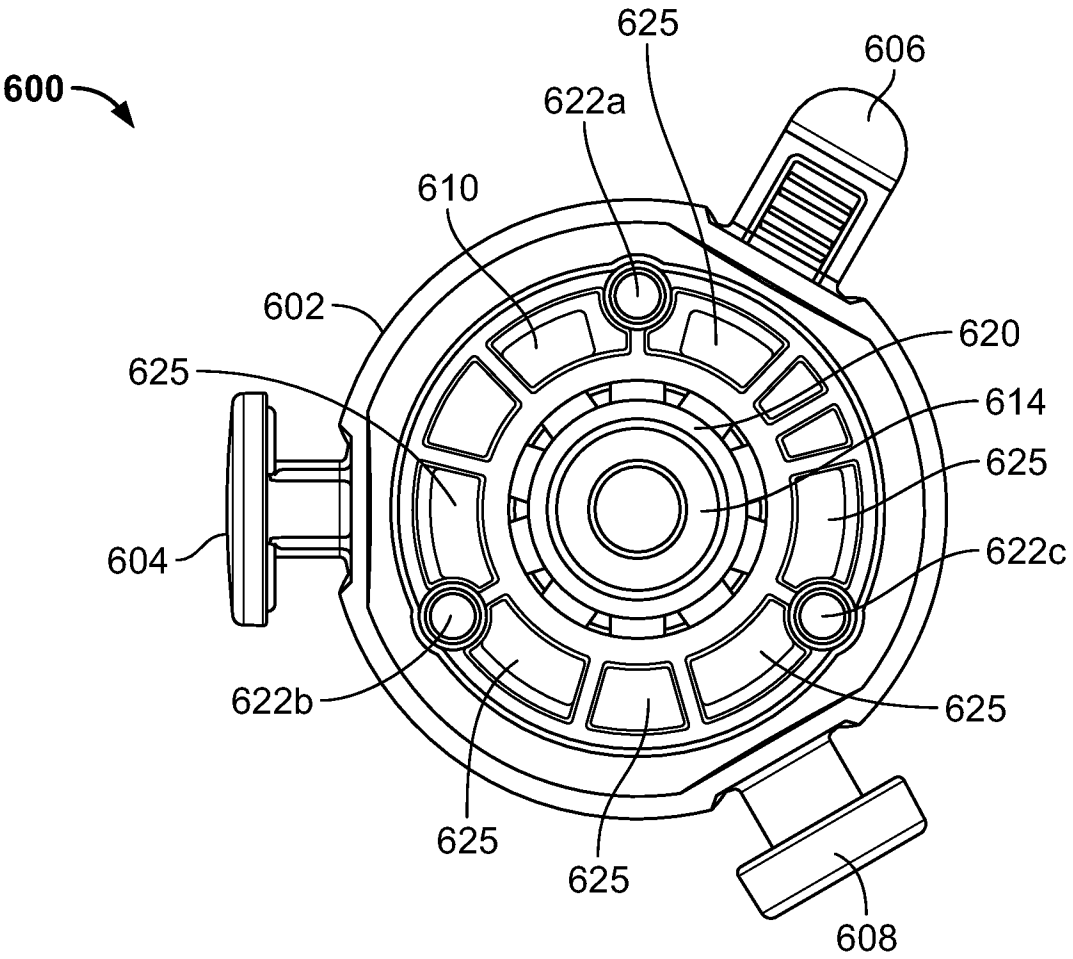
FIG. 6 illustrates a back plan view of the vibrating head assembly of the massager, in accordance with an embodiment of the present specification.

FIG. 6 illustrates a back view of the vibrating head assembly of the massager, in accordance with an embodiment of the present specification. The ball bearing contact area 614 and at least one retaining member 620 are placed within the vibrating portion 602 as shown. Also an inside or rear surface of front cover 610 is visible through a plurality of recesses 625 formed within a base of the vibrating head assembly 600. The pins 622*a*, 622*b* and 622*c* connect the vibrating head assembly 600 to a bearing mount assembly and restrict free rotatory movement of the vibrating portion 602. Also visible in the figure are three treatment areas or surfaces 604, 606 and 608, in accordance with various embodiments.

Figure 7:
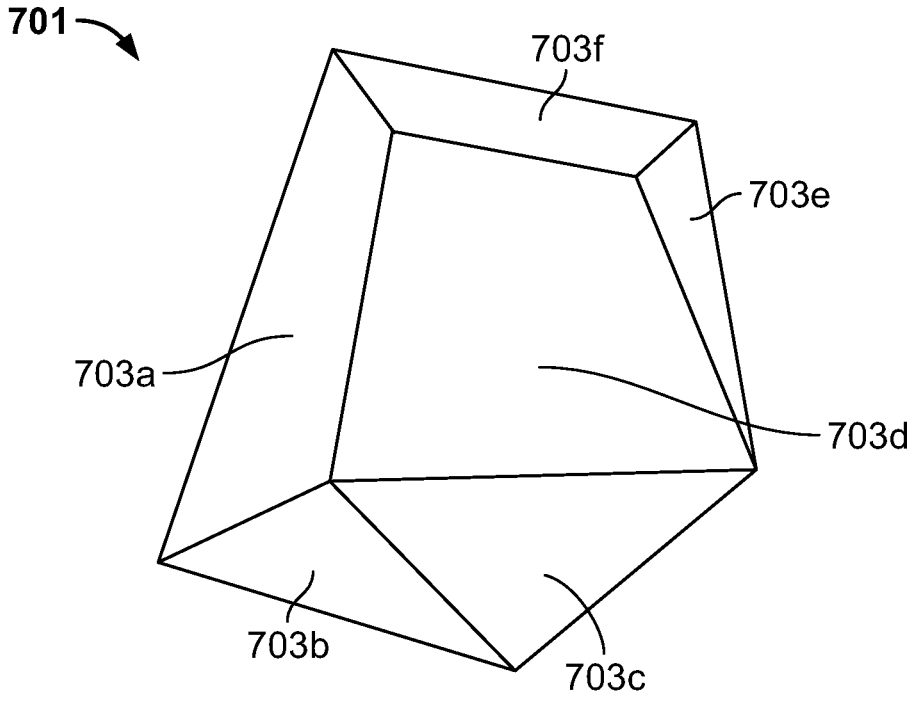
FIG. 7 illustrates an alternate embodiment of a cap having a plurality of surfaces for covering the vibrating head of the massager.

In an optional embodiment, the vibrating head or portion 602 is covered with a cap having multiple surfaces. Each of the multiple surfaces acts as a treatment surface and may be used for massaging a body part. FIG. 7 illustrates a cap having multiple surfaces for covering the head of the massager. Cap 701 comprises a plurality of flat treatment surface areas 703*a*, 703*b*, 703*c*, 703*d*, 703*e*, and 703*f*. Each of these treatment surfaces may be applied to a user's skin for providing a massage therapy. In an embodiment, cap 701 is made of plastic. It would be apparent to persons of skill in the art, that any suitable material such as, but not limited to, hardened rubber, silicone may be used to construct the cap 701. Also, cap 701 may comprise multiple flat surfaces differently shaped and sized.

Figure 8A:
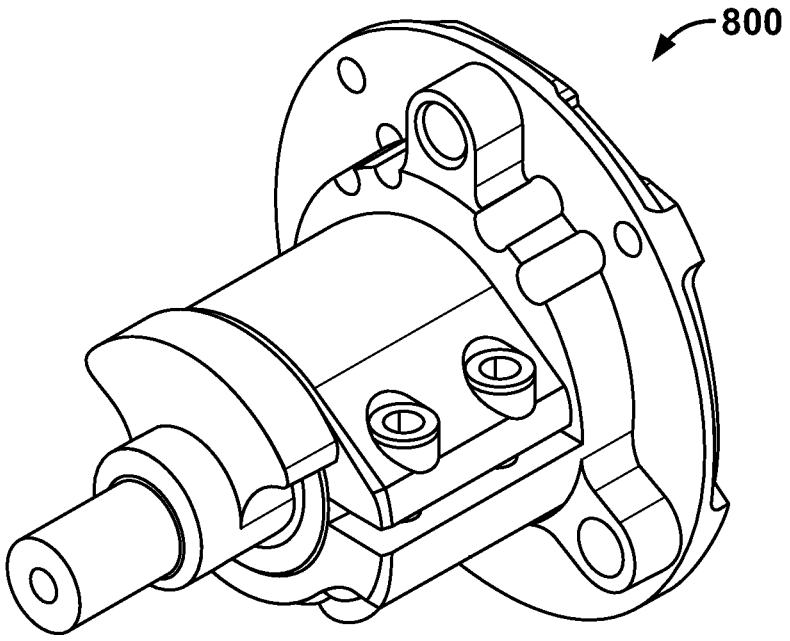
FIG. 8A is a diagram of the bearing mount assembly of the massager, in accordance with an embodiment of the present specification.
Figure 8B:
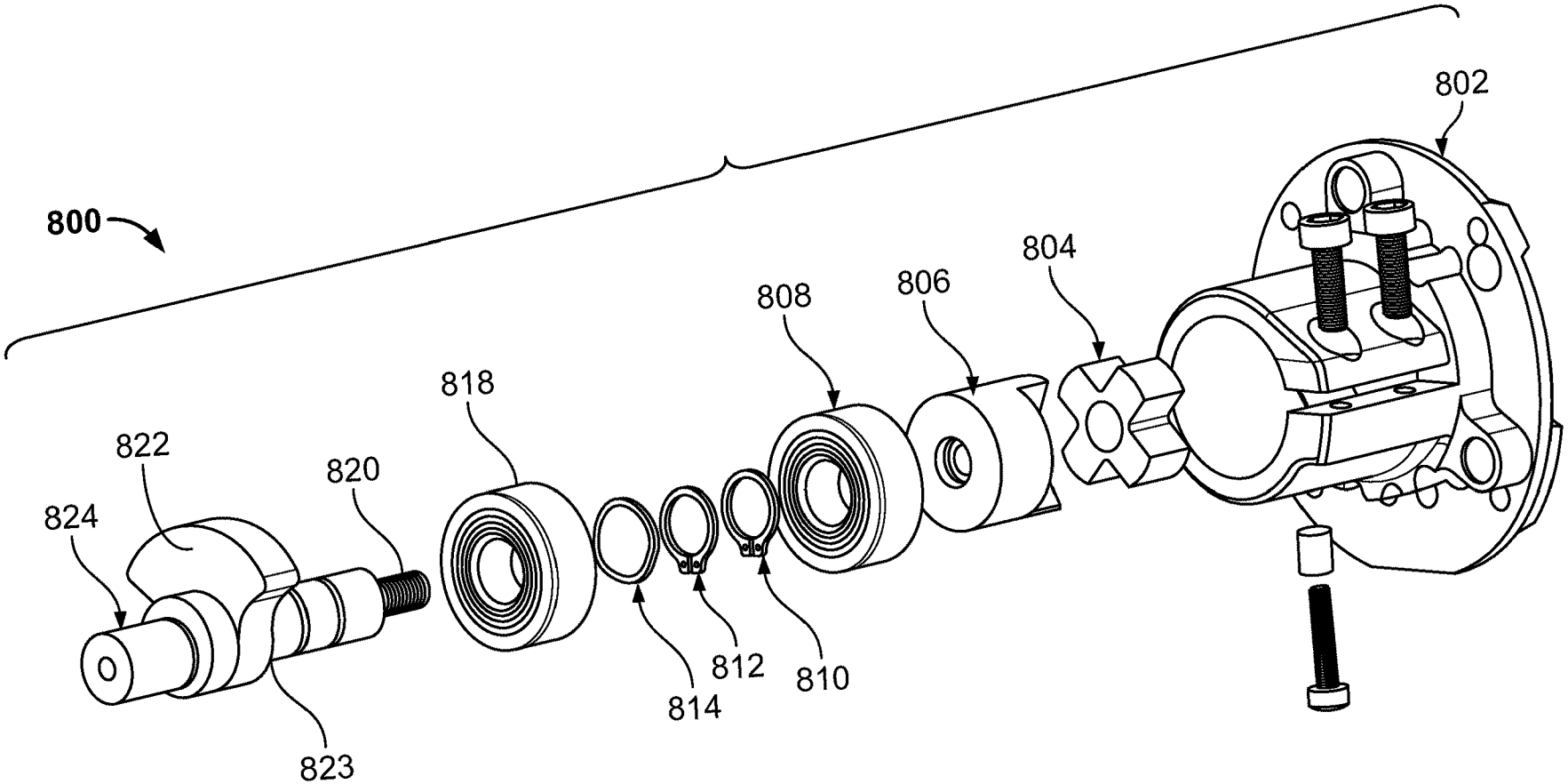
FIG. 8B is an exploded view illustrating the bearing mount assembly of the massager, shown in FIG. 8A; and, FIG. 9 is an exploded view illustrating the circuit board and motor assembly portion of the massager, in accordance with an embodiment of the present specification.

As shown in FIG. 3, bearing mount assembly is coupled to the motor of the massager via an eccentric shaft and the vibrating head via the rotational stabilizer and pin assembly. FIG. 8A is a diagram of the bearing mount assembly of the massager, in accordance with an embodiment of the present specification. FIG. 8B is an exploded view illustrating the bearing mount assembly of the massager, shown in FIG. 8A. Referring to FIGS. 8A and 8B, bearing mount assembly 800 comprises a bearing mount housing 802, which houses a spider shaft coupling 804, a jaw coupler 806, a first ball bearing 808, a second ball bearing 818, a first shaft 820, a counterweight 822, and a second shaft 824. In an embodiment, positioned within respective grooves of the two stacked ball bearings are a first retaining ring 810, a second retaining ring 812, and a wave spring 814. In an embodiment, first shaft 820 runs through the first ball bearing 808 and the second ball bearing 818, until a base of a cylindrical protrusion 823 housing the counterweight 822 rests above the second ball bearing 818. In an embodiment, the ball bearings 808 and 818 are separated by approximately 0.25 inches of first shaft 820. The portion of shaft 820 separating the two ball bearings provides greater stability to the massager mechanism during operation.

In an embodiment, counterweight 822 is positioned between first shaft 820 and second shaft 824. In an embodiment, second shaft 824 is an eccentric shaft. Eccentric shaft 824 is solidly fixed to a rotating axle at its proximal end, which in an embodiment is first shaft 820, with the central axis of the eccentric shaft 824 being offset from that of the axle of the main shaft 820. The degree of eccentricity or degree of offset of eccentric shaft 824 from the center axis of the main shaft 820 is, in one embodiment, ½ the stroke length. Counterweight 822 and second shaft 824 protrude from bearing mount housing 802 so that eccentric shaft 824 can be coupled to the massage head via a hole located within the massage head. In an embodiment a proximal portion of first shaft 820 exits the bearing housing so that it may be coupled to a shaft located on the motor assembly via the jaw coupler 806 and spider shaft coupling 804. Coupled in this manner, the eccentric shaft 824 allows for the rotational motion that is created by the motor and the main shaft 820 to be translated into an orbital motion.

In an alternate embodiment, a singular ball bearing may be used, wherein the single ball bearing is capable of retaining angular motion while minimizing pivot. In an embodiment, the singular ball bearing is an angular contact bearing.

In an embodiment, the counterweight 822 is shaped as a partial disc and comprises a top surface, a bottom surface identical to the top surface, a first side surface, a second elongated side surface and a third side surface identical to the first side surface. Counter weight 822 is coupled with a first cylindrical shaft 820 which in turn is coupled with a second cylindrical shaft 824. Shaft 820 is smaller in diameter than shaft 824. In conventional massagers, a counterweight is used to create motion such as for swinging the massage head from side to side. However, in various embodiments of the present specification, counterweight 822 positioned near the massager head balances the centrifugal forces created due to orbital movement of the vibrating portion of the massager head which is restrained by the use of three pins, as shown earlier. The centrifugal force would otherwise make the entire massage head shake during operation of the massager. The counterweight is sized and positioned to balance centrifugal force created by the constrained rotational forces.

In another embodiment, a second counterweight is also used in the massager for increasing stability. The second counterweight may be positioned in a different plane than the first counterweight closer to the massager's motor and further down from the head. The inclusion of more than one counterweight further minimizes a shaking of the handle of the massager during operation.

In various embodiments, the treatment surface provided on the center of the massage head of the massager also provides therapeutically beneficial heat without the use of a separate heater during operation of the massager. The bearing components surrounding the portion that receives the eccentric shaft in the massage head (shown as 614 in FIG. 6) and the bearing mount 802 coupled with the shaft generate heat because of friction during operation of the motor of the massager and is transferred from the center of the shaft through the plastic portions of the massage head. The heat is thus transferred through the shaft to a middle of the treatment surface provided on the center of the massage head. Hence, due to the positioning of the eccentric shaft relative to the treatment surface provided on the center of the massage head, heat is automatically generated and delivered through the center of that treatment surface. This allows for the delivery of therapeutically beneficial heat without the use of a separate heater.

Figure 9:
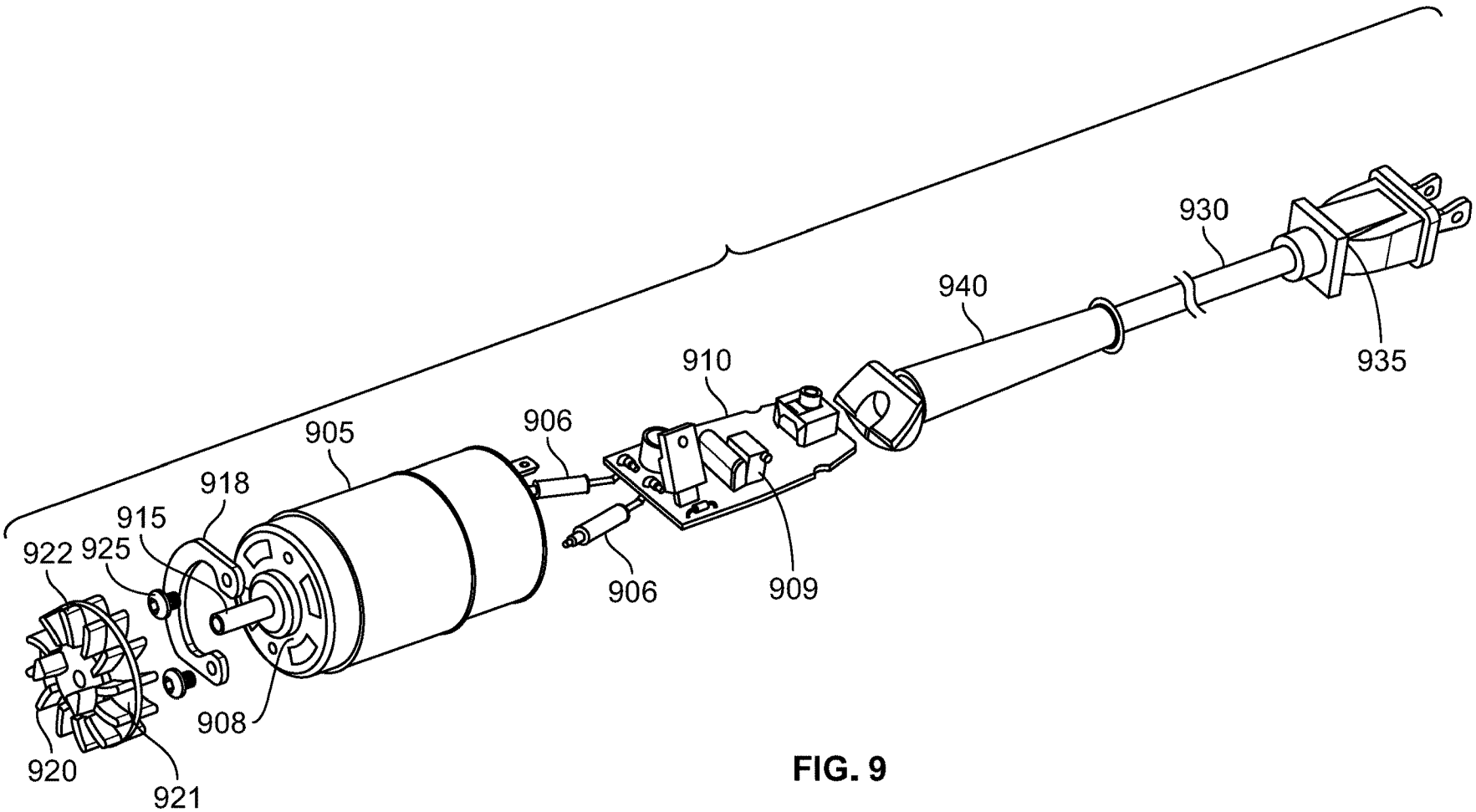

FIG. 9 is an exploded view illustrating the circuit board and motor assembly portion of the massager, in accordance with an embodiment of the present specification. In accordance with an embodiment, a motor 905 provides rotatory motion to a head of the massager. In various embodiments, the motor 905 may be a 110V or a 220V HVDC motor. A proximal end of the motor 905 is electrically connected (via connecting joints 906) to a printed circuit board assembly 910. An axle or shaft 915 protrudes distally from the motor 905 to support a coupling fan 920. The fan 920 is mounted on the axle or shaft 915 by placing the axle 915 through a central hole of the fan 920. The coupling fan 920 comprises a circular base 921 and multiple teeth 922 coupled with and protruding from a cylindrical shaft coupled with the circular base 921. A motor retention plate 918 is affixed to a distal surface 908 of the motor 905 by means of screws 925, to lie between the motor 905 and the fan 920.

The circuit board assembly 910 comprises a circuit board, a switch and a potentiometer 909. The switch is housed near the circuit board. The potentiometer 909 is positioned on the circuit board. The switch is coupled with the potentiometer 909 and the motor 905 and is used to control the rotational speed of the motor 905, which in turn controls the vibrational speed of the one or more treatment heads of the massager. A power cord 930 extends proximally from the circuit board assembly 910 and ends into a power plug 935. In various embodiments, the power cord 930 is housed or sheathed in a strain relief housing or sheath 940 near a proximal end of the circuit board assembly 910.

The RRT massager of the present specification provides a precise combination of frequency and amplitude for causing fast, and effective pain relief. The RRT massager is safe, portable and easy to use, providing fast treatment options by targeting affected body areas, at a low operating cost. The RRT massager may also be used for assisting athletes in pre-workout power and post workout recovery. The RRT vibration therapy and massager of the present specification is effective in nearly every stage of treatment of multiple types of tissue ailments ranging from acute to chronic.

The above examples are merely illustrative of the many applications of the system of the present specification. Although only a few embodiments of the present specification have been described herein, it should be understood that the present invention might be embodied in many other specific forms without departing from the spirit or scope of the invention. Therefore, the present examples and embodiments are to be considered as illustrative and not restrictive, and the invention may be modified within the scope of the appended claims.

I claim:

1. A massager comprising:

a motor for generating rotational motion;

an applicator head comprising a plurality of treatment surfaces;

at least one shaft attached to said motor and said applicator head for translating said rotational motion to the applicator head;

a restraining mechanism attached to said applicator head, wherein the restraining mechanism comprises a plurality of substantially elongate pins having distal ends attached to the applicator head and proximal ends housed within sockets positioned on a portion of the massager, and wherein the restraining mechanism is configured to prevent the applicator head from rotating, thereby generating vibrational motion in said applicator head and a substantially orbital motion in said plurality of treatment surfaces; and a cylindrical component that surrounded the at least one shaft, wherein the cylindrical component comprises a plurality of channels or grooves that are configured to accommodate the plurality of substantially elongate pins.

2. The massager as claimed in claim 1, wherein at least one of the plurality of treatment surfaces projects radially outwards from the applicator head.

3. The massager as claimed in claim 1, wherein the plurality of treatment surfaces includes a first treatment surface, a second treatment surface, and a third treatment surface and wherein the first treatment surface has a coefficient of friction with a user's skin that is different than a coefficient of friction of the second treatment surface with a user's skin or a coefficient of friction of the third treatment surface with a user's skin.

4. The massager as claimed in claim 1, wherein the plurality of treatment surfaces includes a first treatment surface, a second treatment surface, and a third treatment surface and wherein the first treatment surface comprises a material that is more compliant than a material covering the second treatment surface or a material covering the third treatment surface.

5. The massager as claimed in claim 1, wherein at least one of the plurality of treatment surfaces comprises silicone.

6. The massager as claimed in claim 1, wherein three of the plurality of treatment surfaces project radially outwards from the applicator head and are positioned equidistant from each other on a periphery of the applicator head.

7. The massager as claimed in claim 1, wherein a frequency of the vibrational motion ranges from 75 Hz to 250 Hz.

8. The massager as claimed in claim 1, wherein the orbital motion causes said plurality of treatment surface to move in an approximately circular motion with diameters ranging from 0.1 millimeters (mm) to 5 mm.

9. The massager as claimed in claim 8, wherein the plurality of treatment surfaces move in an approximately circular motion with a speed ranging from 100 to 200 circles per second.

10. The massager as claimed in claim 1, wherein each socket of the plurality of sockets has a pre-defined volume and wherein the proximal end of each pin floats freely within each socket of the plurality of sockets.

11. The massager as claimed in claim 10, wherein the proximal end of each pin is barrel-shaped and wherein each socket of the plurality of sockets is substantially cylindrical.

12. The massager as claimed in claim 1, wherein the at least one shaft is coupled with a counterweight for balancing centrifugal force caused by eccentric motion of the applicator head.

13. The massager as claimed in claim 1, further comprising a bearing mount assembly comprising multiple ball bearings mounted on the at least one shaft for operating the applicator head.

14. The massager as claimed in claim 1, further comprising a circuit board comprising at least a potentiometer and a switch for controlling a speed of the motor.

15. A massager comprising:

a motor for generating rotational motion;

an applicator head comprising a plurality of treatment surfaces;

a rotating shaft attached to said motor and an eccentric shaft attached to said applicator head for translating said rotational motion to the applicator head to a substantially circular motion;

a bearing mount assembly positioned concentrically relative to at least one of the rotating shaft or eccentric shaft and proximal to the applicator head;

a restraining mechanism attached to said applicator head, wherein the restraining mechanism comprises a cylindrical component positioned around said bearing mount assembly and proximal to said applicator head and wherein the cylindrical component comprises a plurality of protrusions adapted to have a non-friction fit within complementary recesses located in a base of the applicator head, and wherein the restraining mechanism is configured to prevent the applicator head from rotating, thereby generating a substantially circular motion in said plurality of treatment surfaces and wherein the substantially circular motion of said plurality of treatment surfaces has a diameter in a range of 0.1 millimeters (mm) to 5 mm and a frequency of 100 -200 circular movements per second.

16. The massager as claimed in claim 15, wherein the plurality of treatment surfaces includes a first treatment surface, a second treatment surface, and a third treatment surface, wherein the first treatment surface, second treatment surface, and third treatment surface project radially outward from the applicator head, wherein the first treatment surface is harder than the second treatment surface, and wherein the third treatment surface is rounder than the first treatment surface or second treatment surface.

17. The massager as claimed in claim 15, wherein an outer circumference of the cylindrical component comprises at least one channel, wherein said at least one channel is adapted to accommodate a member connecting the applicator head to a proximal portion of the massager.

* * * * *